US006000789A

United States Patent [19]

Takagi et al.

[11] Patent Number: 6,000,789

[45] Date of Patent: Dec. 14, 1999

[54] PRINTER AND INK TANK

[75] Inventors: Jun Takagi; Katsuyuki Fujii; Ichiro Tomikawa, all of Ebina, Japan

[73] Assignee: Fuji Xerox Co., Ltd., Tokyo, Japan

[21] Appl. No.: 08/838,925

[22] Filed: Apr. 23, 1997

[30] Foreign Application Priority Data

Apr. 23, 1996 [JP] Japan ..... 8-101518
Jun. 20, 1996 [JP] Japan ..... 8-160132

[51] Int. Cl.[6] ..... B41J 2/175

[52] U.S. Cl. ..... 347/86

[58] Field of Search ..... 347/7, 49, 85, 347/86, 87

[56] References Cited

U.S. PATENT DOCUMENTS 5,126,767 6/1992 Asai ..... 347/86

5,552,816 9/1996 Oda et al. ..... 347/86

*Primary Examiner*—N. Le
*Assistant Examiner*—Anh T. N. Vo
*Attorney, Agent, or Firm*—Oliff & Berridge, PLC

[57] ABSTRACT

A joint part of an ink tank has a connection part capillary member. A filter is placed at the tip of an ink introduction part on the side of a recording head. The ink tank is connected by bringing a face of the filter into contact with the connection part capillary member; liquid connection is made without entry of air. At this time, a force of pressing the connection part capillary member against the inside of the ink tank occurs. However, since the connection part capillary member is provided with a presser part on the rear side, the presser part absorbs the press pressure and the contact state is stable, preventing the connection part capillary member from being detached to the inside of the ink tank. Additionally, the ink tank has a seal material for sealing the ink supply hole in a state in which the tank joint part is detached from the recording head joint part.

22 Claims, 22 Drawing Sheets

PRINTER AND INK TANK

BACKGROUND OF THE INVENTION

1. Field of the Invention

This invention relates to an ink jet printer and an ink tank for supplying ink to a recording head in the printer and in particular to a printer with an ink tank that can be detached by the user for replacement.

2. Description of the Related Art

Hitherto, an ink jet cartridge made up of a head cartridge having an ink jet recording head and a tank holder and an ink tank that can be attached to or detached from the tank holder has been known as an ink jet cartridge used with an ink jet recorder. With such an ink jet cartridge, when ink is consumed, only the ink tank may be replaced; the ink jet cartridge is advantageous to reduction in costs as compared with an ink jet cartridge with a head cartridge and an ink tank molded in one piece.

However, in an ink jet printer using such an ink tank, when the ink tank is attached at the ink tank replacement time, ink leaks from an ink supply hole made in the bottom of the ink tank and is deposited on the inside of the ink jet recorder or makes user's hand dirt, etc. Further, when the ink tank is replaced, bubbles are drawn into an ink flow passage, thereby causing an ink jet failure to occur, lowering image quality.

As one of solutions to this problem, a structure is effective wherein a joint part is provided with an ink reservoir without supplying ink directly from an ink-impregnated member being disposed in an ink tank for holding ink. However, in this structure, an ink leakage in the joint part introduces another problem.

To prevent ink from leaking in the joint part, a structure wherein an ink outlet of an ink tank is made of a rubber stopper and an ink supply metal needle is made to pierce the rubber stopper for direct liquid connection to an ink flow passage to a recording head is known, for example, as disclosed in Japanese Patent Laid-Open No. Hei 3-92356. The ink supply needle in the structure uses a pipe having corrosion resistance to ink and the pipe has a tip made extremely sharp so as to be able to pierce the rubber stopper and is formed on a side face with an ink supply hole about 1 mm in diameter. Such an ink supply needle enables liquid connection and the ink supply port of the ink tank is closed by the elastic force of the rubber stopper, preventing ink from leaking. However, if the user handles the ink supply needles carelessly, he or she may touch the sharp pipe tip and be hurt. Further, since the ink supply needle itself has a small inner diameter, a broken piece of the pierced rubber stopper is mixed into the ink supply needle and interferes with an ink supply.

As another solution, a structure wherein an ink outlet is made up of two rings and a supply port seal is available, for example, as disclosed in Japanese Patent Laid-Open No. Hei 7-125238. In this structure, an ink supply metal needle is not made to pierce a rubber stopper, thus the risk of a broken piece of the rubber stopper mixed into the ink supply needle is reduced, but a sharp pipe must be still used, introducing the problem that the user may touch the sharp pipe tip and be hurt.

As another solution, a structure wherein the ink supply hole tip is provided with a packing member having a through hole and the through hole is sealed by a seal member, then an ink supply tube having a comparatively dull tip is made to pierce the seal member is available, for example, as described in Japanese Patent Laid-Open No. Sho 50-74341. However, the art involves a problem of leakage of a minute amount of ink from space between the ink supply tube piercing the seal member and the seal member.

Hitherto, the following art described in Japanese Patent Laid-Open Nos. Hei 6-312515 and Hei 6-320749 has been known as a method for solving the problem:

In the art described here, a cylindrical ink supply tube projecting outward is disposed on the ink jet recording head side and is formed at the tip with a plurality of projections. On the other hand, a breakable heat-seal film made of an ink non-permeability material is put on an ink supply hole made in the bottom of an ink tank. When the ink tank is attached, the heat-seal film is broken by the projections of the ink supply tube tip and the ink supply tube is connected to the ink supply hole.

However, in the structure, a broken piece of the heat-seal film broken by the projections of the ink supply tube tip may block the ink supply tube partially, making it impossible to supply ink stably.

The following art shown in FIGS. 28A and 28B are possible as a method for solving the problem with the above art:

FIGS. 28A and 28B are schematic illustrations of an ink tank T and a recording head section H designed for solving the problem with the above art; FIG. 28A is an overall illustration and 28B is an enlarged view of the main part of the ink tank T. A ring-like abutment part 102 projecting like a ring so as to make an ink supply hole 101 inside the abutment part 102 is disposed at the bottom of the ink tank T. An ink inflow hole 103 into which ink supplied from the ink supply hole 101 flows is made in the ink jet recording head H. An abutment member 103*a* abutting the ring-like abutment part 102 when the ink tank T is attached is disposed in the ink inflow hole 103.

In the structure, when the ink tank T is not used, a soft seal material 104 is put on the tip of the ring-like abutment part 102 of the ink tank T with an adhesive or by heat sealing, etc., for sealing the ink supply hole 101. When the ink tank T is used, the worker peels off the seal material 104, attaches the ink tank T to the ink jet recording head H, and abuts the ring-like abutment part 102 against the abutment member 103*a*.

In the art structure, the seal material 104 is put on the tip of the ring-like abutment part 102 by bonding or heat sealing, but the area of the bonding or heat sealing portion is small, thus the seal material 104 easily peels off. Therefore, when the ink tank T is not used and is stored, it is feared that the seal material 104 will peel off, allowing ink to leak.

In heat sealing, when the seal material 104 is heat-sealed in the contact portion with the tip of the ring-like abutment part 102, not only the seal material 104, but also the sharp-pointed tip of the ring-like abutment part 102 melts. If the sharp-pointed tip of the ring-like abutment part 102 melts, when the ink tank T is attached to the recording head H, the tip of the ring-like abutment part 102 is not engaged in the abutment member 103*a* and ink leakage easily occurs.

In bonding, when the seal material 104 put on the tip of the ring-like abutment part 102 is peeled off at the time of attaching the ink tank T, the adhesive can be left on the tip of the ring-like abutment part 102. If the adhesive is left on the tip of the ring-like abutment part 102, when ink is supplied after the ink tank T is attached, it is feared that the adhesive will dissolve in the ink, deteriorating the ink.

SUMMARY OF THE INVENTION

It is therefore an object of the invention to provide a printer to or from which an ink tank can be attached or detached repeatedly without mixing of bubbles into a flow passage or ink leakage at the ink tank replacement time and without danger, etc., to the user at the replacement time and the ink tank.

Further, the invention prevents ink from leaking in a state in which an ink tank is attached to a recording head or in a storage state of the ink tank before the ink tank is attached.

In order to solve the foregoing conventional problem, according to the invention, there is provided a printer comprising: a recording head section for jetting ink liquid and an ink tank for holding the ink liquid to be supplied to the recording head, wherein the recording head is connected at a joint part of the ink tank, and the ink tank further comprising: a capillary member being contained in the joint part, and a presser part for receiving press pressure exerted on the capillary member when the ink tank and the recording head are connected.

Further, there is provided an ink tank for an ink jet recorder comprising: an ink tank main unit having a tank joint part connected detachably to a recording head joint part having an ink inflow hole communicating with an ink nozzle for jetting ink to a print face and a ring-like abutted member provided in the ink inflow hole, the tank joint part having a ring-like abutting part having a projecting tip abutting the ring-like abutted member in a state in which the tank joint part is connected to the recording head joint part, and an ink supply hole communicating with the ink inflow hole; and a seal material formed of a flexible sheet for covering the ring-like abutting part to seal the ink supply hole in a state in which the tank joint part is detached from the recording head joint part, the seal material having a bonding outer margin part bonded to an outside face of the ink tank main unit outside the ring-like abutting part and a closing part being disposed in an inner portion of the bonding outer margin part for closing the ink supply hole.

In the ink tank for an ink jet recorder according to the above aspect of the invention, the closing part of the seal member prevents an adhesive from being deposited on the tip of the ring-like abutting part, and melting deformation caused by heat sealing, etc., does not occur. Since the bonding outer margin part of the seal material is bonded to the surface of the ink tank main unit outside the ring-like abutting part, after the seal material is peeled off, the adhesive does not dissolve in ink and there is no fear of contaminating the ink. Since the bonding outer margin part is bonded to the outside surface of the ink tank main unit, the bonding area can be widened as compared with bonding or heat-sealing the seal material to the tip of the ring-like abutting part, so that the seal material becomes hard to peel off from the outer peripheral surface of the ink tank main unit. Thus, ink leakage can be prevented when the ink tank is stored in a state in which the tank joint part is detached from the recording head joint part (state before attachment).

The ring-like abutting part at the tip of the tank joint part enters the ink inflow hole and abuts the ring-like abutted member in the state in which the tank joint part is connected to the recording head joint part. Since the tip of the ring-like abutting part is free of deformation caused by heat sealing or contamination caused by bonding, it can come in intimate contact with the ring-like abutted member for preventing ink leakage, etc.

In the state in which the tank joint part is connected to the recording head joint part, the ink supply hole made in the inside of the ring-like abutting part of the tank joint part communicates with the ink inflow hole. That is, the ink inflow hole of the recording head joint part and the ring-like inner face of the ring-like abutted member disposed in the ink inflow hole communicate with the ink nozzle. In this state, ink is jetted through the ink nozzle to the print face for printing.

BRIEF DESCRIPTION OF THE DRAWINGS

In the accompanying drawings:

FIG. 15A is an illustration of the ink tank and FIG. 15B is an illustration of a connection bottom wall member;

FIG. 26A is an illustration to show a state before the ink tank fits into a tank holder hole and FIG. 26B is an illustration to show a state in which the ink tank is attached to the recording head section;

FIG. 27A is an enlarged illustration of the main part and FIG. 27B is an illustration of a seal member of the fifth embodiment of the invention; FIG. 28A is an overall illustration and 28B is an enlarged view of the main part of the ink tank.

DETAILED DESCRIPTION OF THE INVENTION

Figure 1:
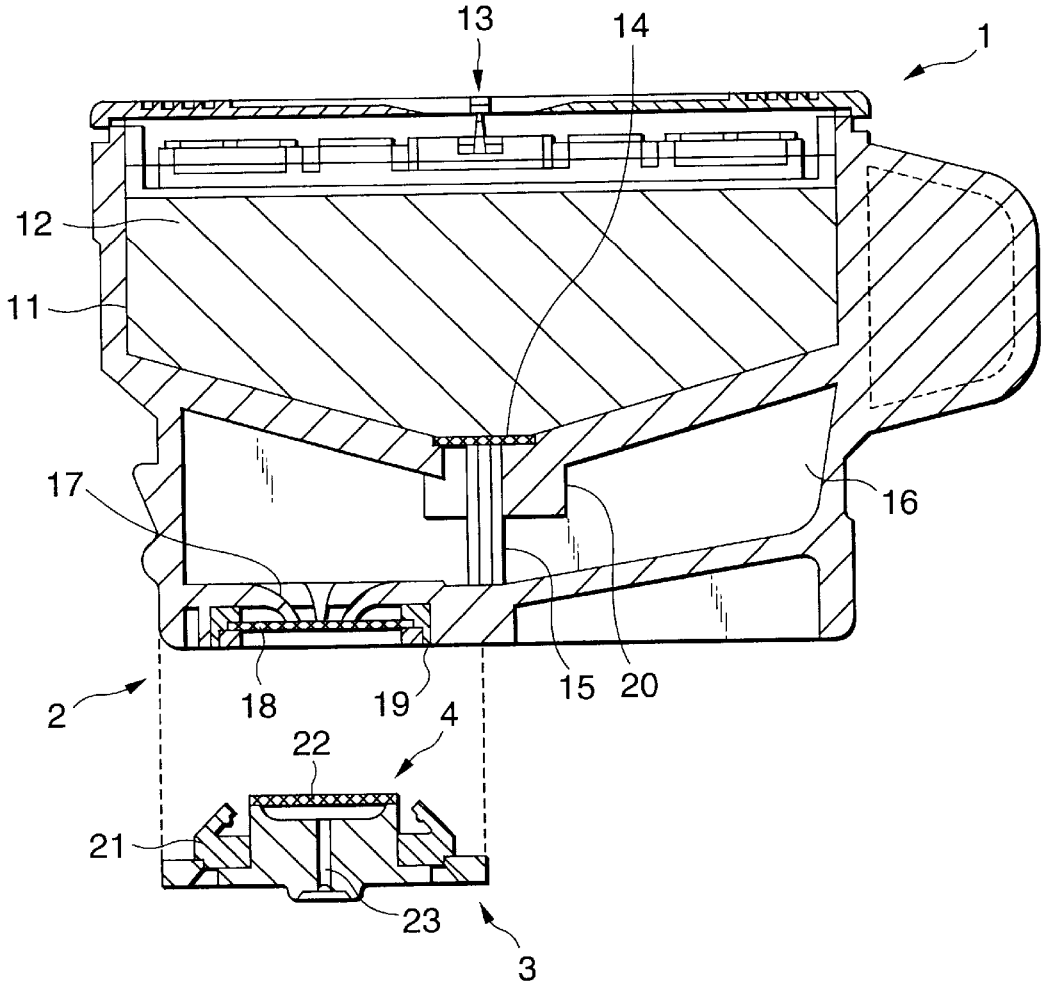
FIG. 1 is a sectional view of the main part in first embodiment of a printer and an ink tank of the invention.
Figure 2A:
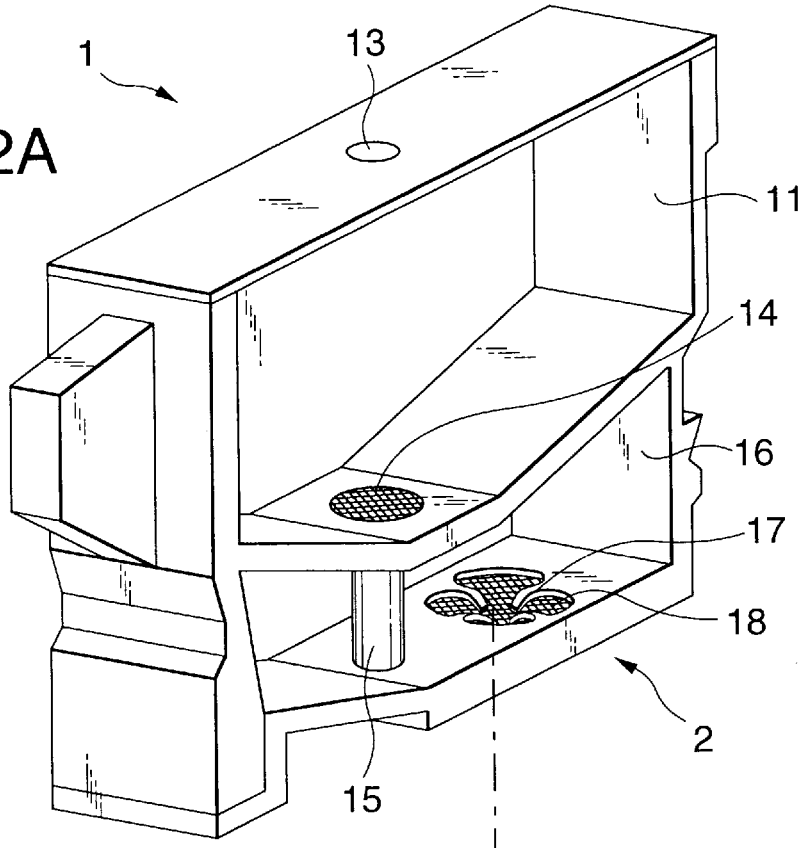
FIGS. 2A and 2B are a perspective view of the main part in the first embodiment of the printer and the ink tank of the invention.
Figure 2B:
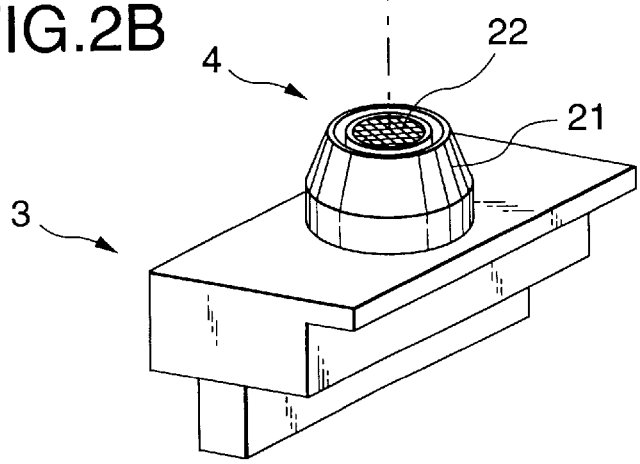

FIGS. 1 and 2 show first embodiment of a printer and an ink tank of the invention. In the figures, numeral 1 is an ink tank, numeral 2 is a joint part, numeral 3 is a recording head, numeral 4 is an ink introduction part, numeral 11 is a main ink chamber, numeral 12 is an ink chamber capillary member, numeral 13 is an atmosphere communication port, numeral 14 is a meniscus formation member, numeral 15 is an ink guidance member, numeral 16 is an intermediate chamber, numeral 17 is a presser part, numeral 18 is a connection part capillary member, numeral 19 is a joint outer peripheral part, numeral 20 is an ink guidance member presser, numeral 21 is a joining member, numeral 22 is a filter, and numeral 23 is an ink flow passage. FIGS. 1 and 2 show a state before the ink tank 1 is attached; they show a structure wherein the recording head 3 is attached to a printer and the ink tank 1 is attached to the recording head 3, and show only the ink tank 1 and the ink flow passage portion of the recording head 3. In FIG. 2, one side wall of the ink tank 1 and the ink chamber capillary member 12 are removed.

The ink tank 1 is connected to the recording head 3 at the joint part 2. The joint part 2 of the ink tank 1 abuts the ink introduction part 4 of the recording head 3, whereby the ink flow passage is connected to the ink tank 1 for supplying ink therefrom.

The ink tank 1 contains the main ink chamber 11 and the intermediate chamber 16 below the main ink chamber 11. The main ink chamber 11 contains the ink chamber capillary member 12 for holding ink by a capillary force and keeping a negative pressure. The atmosphere communication port 13 that can communicate with the ink chamber capillary member 12 is made on the top of the main ink chamber 11. A communication hole is made in the bottom of the main ink chamber 11 for communication with the intermediate chamber 16. The ink chamber capillary member 12 communicates on the top with the atmosphere and is released to the atmosphere. Thus, when ink is supplied, ink in the ink chamber capillary member 12 is pressed by atmospheric pressure and is drawn out into the intermediate chamber 16 side by negative pressure from the lower part of the ink chamber capillary member 12. The bottom face of the main ink chamber 11 is formed as a slope with the communication hole as the lowest part.

The meniscus formation member 14 having a large number of minute holes is placed on the communication hole made in the bottom face of the main ink chamber 11. The bottom part of the ink chamber capillary member 12 is abutted against the meniscus formation member 14 for placement. When the ink chamber capillary member 12 is impregnated with ink, the ink passes through the meniscus formation member 14 and moves to the intermediate chamber 16. When the ink chamber capillary member 12 becomes empty of ink, an ink meniscus formed on the minute holes of the meniscus formation member 14 touching the ink chamber capillary member 12 is pressed by atmospheric pressure and bubbles overcoming surface tension of the meniscus and passing through the meniscus move to the intermediate chamber 16. Thus, ink supply pressure to the recording head 3 is held at a given pressure or less.

The ink guidance member 15 is disposed below the meniscus formation member 14. The ink guidance member 15 is supported by the meniscus formation member presser 20 projecting from the surrounding wall faces of the communication hole. Alternatively, a part of the meniscus formation member 14 may be used as the ink guidance member 15. The ink guidance member 15 extends to the bottom face of the intermediate chamber 16. When bubbles build up on the lower face of the meniscus formation member 14 and an air layer is produced or the liquid level of ink in the intermediate chamber 16 lowers, the ink guidance member 15 sucks up the ink in the intermediate chamber 16 and supplies the ink to the meniscus formation member 14, whereby the meniscus formation member 14 is always held wet and maintains negative pressure. The ink supply pressure can be maintained in the best condition until ink is consumed.

The intermediate chamber 16 has a portion extending upward above the communication hole. In FIG. 1, the upper walls of the intermediate chamber 16 are made slant so that the periphery of the intermediate chamber 16 becomes higher than the communication hole. The intermediate chamber 16 collects bubbles passing through the meniscus formation member 14 and the connection part capillary member 18 and entering the intermediate chamber 16 in the higher portions of the periphery than the communication hole for preventing mixing of bubbles into the recording head 3 from the joint part 2 and removing air remaining in the connection part.

The joint part 2 for connecting the ink tank 1 to the recording head 3 is disposed on the bottom of the intermediate chamber 16. The joint outer peripheral part 19 of the joint part 2 is formed with a flat face so that the joining member 21 disposed in the recording head 3 easily abuts.

The connection part capillary member 18 is disposed in the joint part 2 so as to cover the ink supply port and is pressed from the inside of the ink tank 1 by the presser part 17. The portion will be described later in detail. When the ink tank 1 is detached and left standing, the capillary force of the connection part capillary member 18 prevents ink in the intermediate chamber 16 from leaking from the joint part 2. When the ink tank 1 is attached, the connection part capillary member 18 serves as a filter for preventing pressure change caused by vibration or shock put on the ink tank 1 or acceleration or preventing mixing of bubbles from the nozzle side of the recording head 3.

The connection part capillary member 18 can be made of a similar material to that of the meniscus formation member 14, for example. Specifically, it can be made of a 40-micron product of filtration particle size of a stainless mesh filter, etc., or fiber-like felt, etc. Polyester, acrylic, polypropylene, etc., can be used as a felt material. Alternatively, nonwoven cloth, sponge, etc., may be used.

On the other hand, the recording head 3 is connected to the joint part 2 of the ink tank 1 in the ink introduction part 4. The joining member 21 is placed surrounding the ink introduction part 4. When the ink tank 1 is attached, the joining member 21 abuts the face of the joint outer peripheral part 19 of the ink tank 1 and becomes deformed, sealing the joining part, thereby preventing ink from leaking from the joining part. For example, silicone rubber, butyl rubber, etc., can be used as a material of the joining member 21. A structure without the joining member 21 is also possible.

The filter 22 is put on the tip of the ink introduction part 4 for preventing mixing of dirt, etc., deposited on the ink introduction part 4 into the ink flow passage 23 when the ink tank 1 is detached. Ink is held by means of ink meniscuses formed on minute holes of the filter 22 for preventing ink from flowing out from the nozzle. For example, a stainless mesh filter having a filtration particle size of 5 to 60 microns or the like can be used as a material of the filter 22. In addition, for example, a ceramic filter, etc., can be used. Specifically, for example, a 20-micron product of filtration particle size of a stainless mesh filter can be used.

Figure 3A:
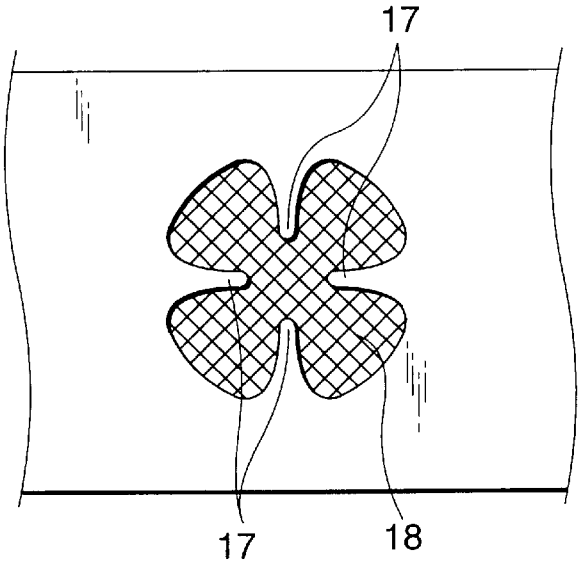
FIGS. 3A, 3B, 3C, 3D, and 3E are enlarged views to show a first specific example of a joint part.
Figure 3D:
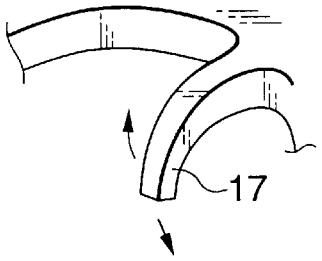
Figure 3B:
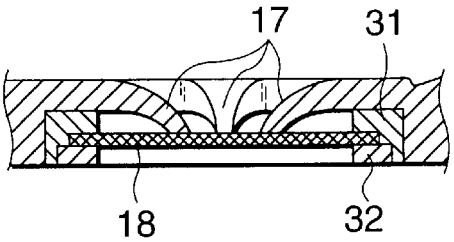
Figure 3E:
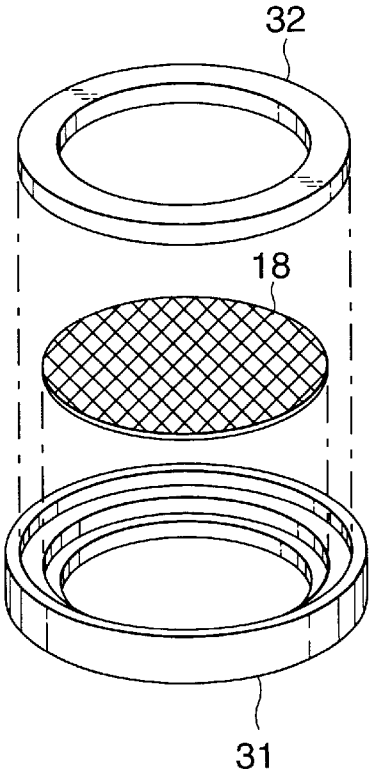
Figure 3C:
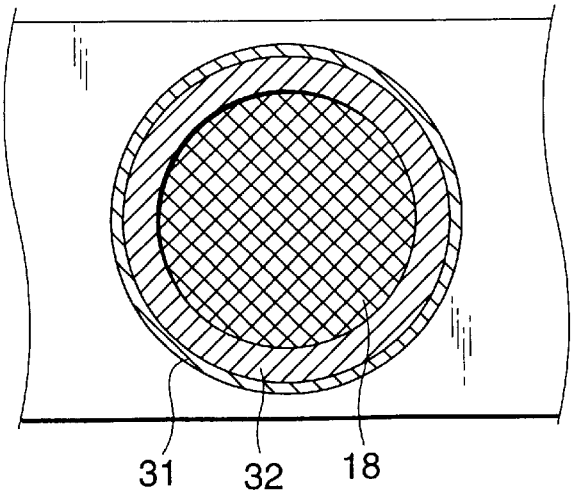

FIGS. 3A to 3E are enlarged views to show a first specific example of the joint part 2. In FIG. 3, numerals 31 and 32 are guides. In the example shown in FIG. 3, the connection part capillary member 18 is entered in the guide 31 and is covered with the guide 32 so that it is sandwiched between the guides 31 and 32, as shown in FIG. 3(E), and the assembly thereof is mounted on the joint part 2 from the outside of the ink tank 1. The joint part 2 is formed with the presser part 17. When the assembly of the guides 31 and 32 and the connection part capillary member 18 is mounted on the joint part 2, the presser part 17 abuts the face of the connection part capillary member 18.

The guides 31 and 32 can be formed of resin. For example, polypropylene can be used as a material of the resin. Of course, any other material may be used. For example, when the guides 31 and 32 are made of polypropylene, after the connection part capillary member 18 is sandwiched between the guides 31 and 32, they can be bonded by thermal sealing.

In the example, the presser part 17 is molded integrally with the bottom member of the ink tank. The bottom member of the ink tank is formed of resin, for example, thus the presser part 17 can also be formed when a housing is molded. As shown in FIGS. 3A and 3D, the presser part 17 can be formed as rib-like arms. To provide an elastic force, polypropylene, polycarbonate, ABS, or the like is appropriate for a material of the ink tank 1. Any other material may be used, needless to say. When press pressure is exerted on the presser part 17, the presser part 17 becomes elastically deformed as shown by arrows in FIG. 3D for absorbing the press pressure.

In FIG. 3, four arm-like portions are formed as the presser part 17, but the number of arm-like portions or the shape may be as desired and can be changed whenever necessary. For example, the number may be three or five. In FIG. 3, the shape of the tip is slender and bent, but may extend straight.

Figure 4A:
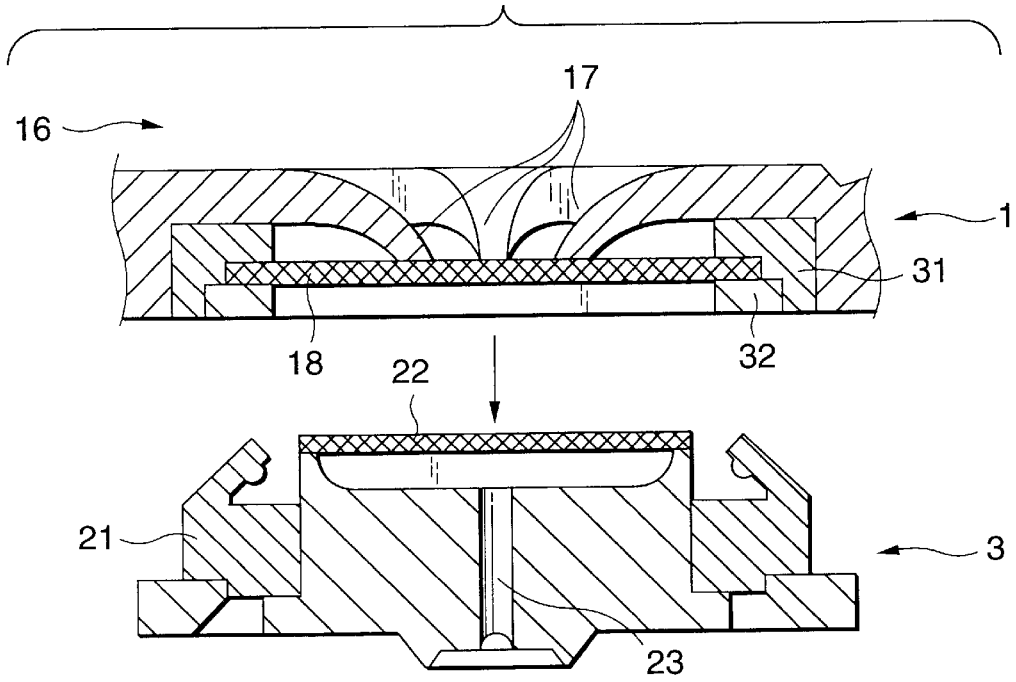
FIGS. 4A and 4B are a sectional view to show a state before and after connection to a recording head in the first specific example of the joint part.
Figure 4B:
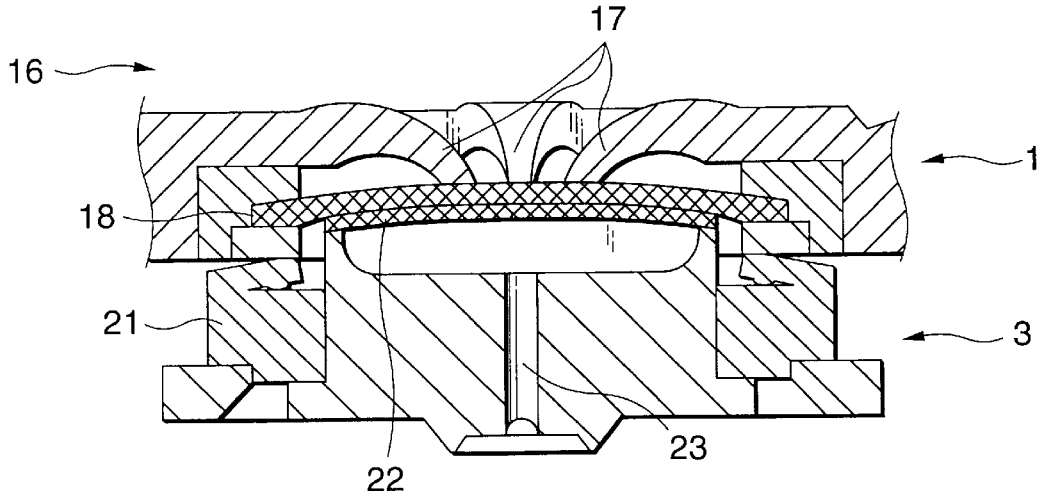

FIG. 4 is a sectional view to show a state before (FIG. 4A) and after (FIG. 4B) connection to the recording head in the first specific example of the joint part. When the ink tank 1 is attached to the recording head 3, the joint part 2 of the ink tank 1 abuts the ink introduction part 4 of the recording head 3, whereby the connection part capillary member 18 and the filter 22 touch, forming an ink flow passage. At this time, only a very small amount of air remains between the connection part capillary member 18 and the filter 22 and is removed by suction at the maintenance time, for example. The capillary force of the connection part capillary member 18 and the filter 22 prevents ink from leaking from the joining part.

When the connection part capillary member 18 abuts the ink introduction part 4, the connection part capillary member 18 is pressed slightly by the ink introduction part 4 and becomes deformed to the inside of the ink tank 1, as shown in FIG. 4B. Since the presser part 17 retains the connection part capillary member 18 from the face opposite to the face of the connection part capillary member 18 abutting the ink introduction part 4, the presser part 17 also becomes elastically deformed. Thus, if the connection part capillary member 18 is pressed, it is retained by the elastic force of the presser part 17, trouble such that the connection part capillary member 18 is detached by press pressure as in the conventional structure does not occur, and the joining part becomes stable.

Figure 5A:
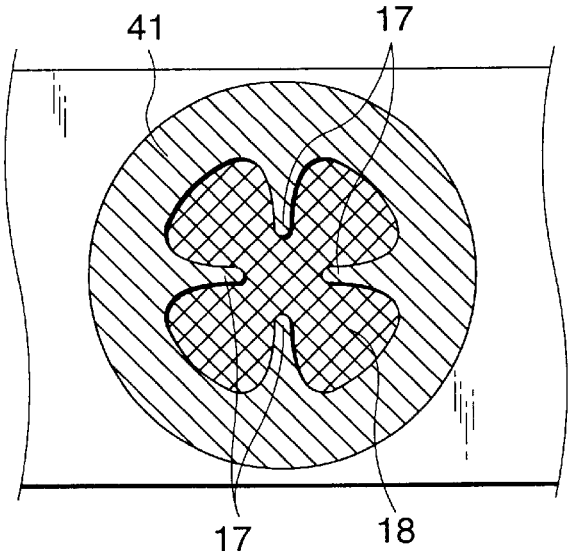
FIGS. 5A and 5B are enlarged views to show a second specific example of the joint part.
Figure 5B:
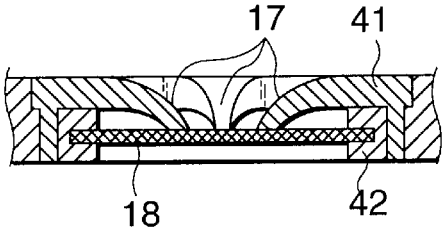
Figure 6A:
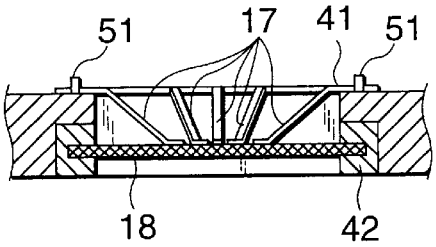
FIGS. 6A and 6B are enlarged views to show a modification of the second specific example of the joint part.
Figure 6B:
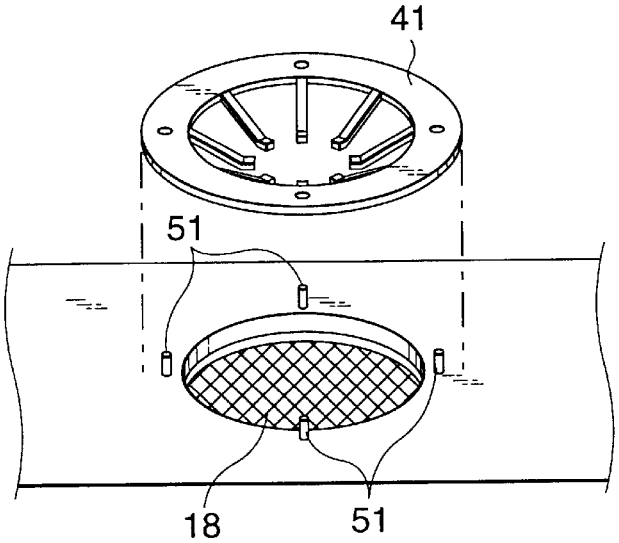

FIGS. 5A and 5B are enlarged views to show a second specific example of the joint part. In FIGS. 5A and 5B, numerals 41 and 42 are guides. A bottom view and the structure of one arm of a presser part are similar to those shown in FIGS. 3C and 3D and are not shown here. In the specific example, the presser part 17 is molded integrally with the guide 41 as a separate member from the bottom member of the ink tank. This structure is effective when the bottom member of the ink tank is formed of a material having no elasticity. Polypropylene, polycarbonate, metal spring material, etc., can be used as a material of the presser part 17 for providing an elastic force for the presser part 17. FIGS. 6A and 6B show a modification of the second specific example of the joint part. In the figure, numeral 51 is a projection. In FIGS. 6A and 6B, a sheet metal made of metal spring material is used as the guide 41 for forming the presser part 17. The guide 41 is attached to the bottom member of the ink tank by projections 51. In this case, a seal, etc., is not required between the bottom member of the ink tank and the guide 41. Of course, any other material may be used, needless to say. The shape of the presser part 17 and the number of arms thereof can be changed as in the first specific example.

In the second specific example shown in FIGS. 5A to 6B, the guide 42 is made of an elastic material of rubber, elastomer, or the like, and the connection part capillary member 18 is caught in the guide 42. This structure is effective when the connection part capillary member 18 is made of a comparatively hard material. Since the guide 42 is made of an elastic material, the periphery of the connection part capillary member 18 can be sealed easily. Of course, the guide 42 may be made of a resin, etc., and bonded to the guide 41 as in the first specific example.

Figure 7A:
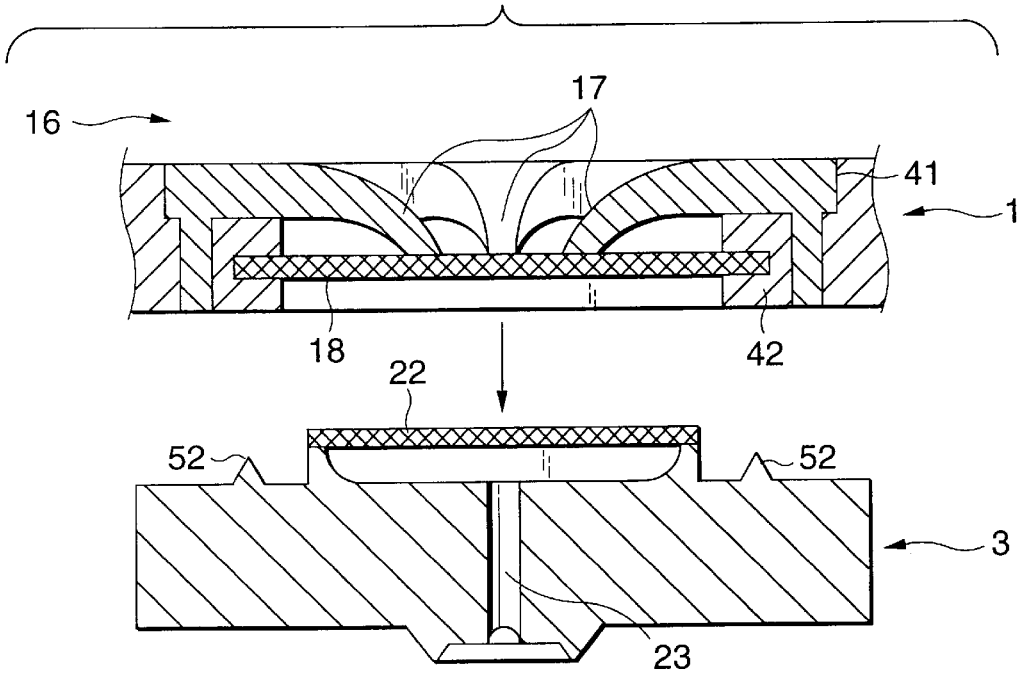
FIGS. 7A and 7B are a sectional view to show a state before and after connection to a recording head in the second specific example of the joint part.
Figure 7B:
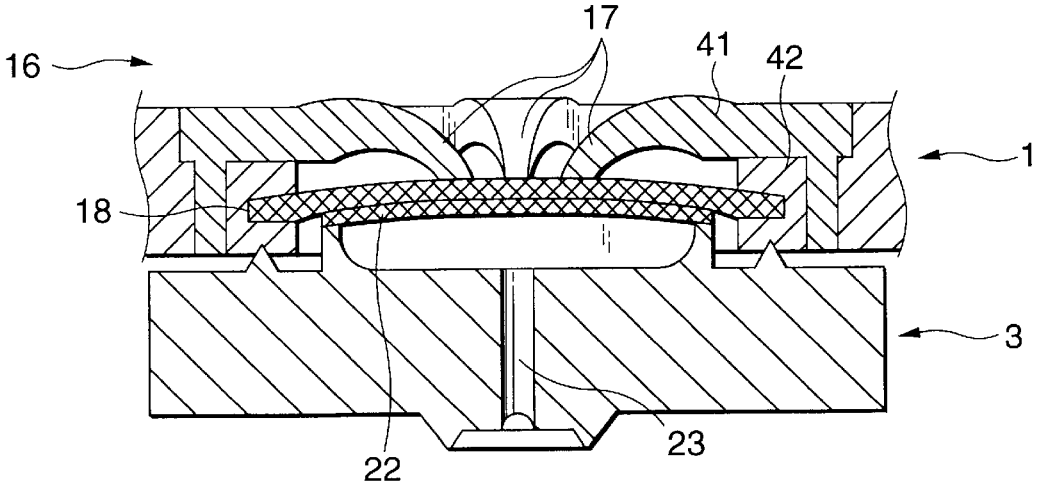

FIG. 7 is a sectional view to show a state before and after connection to the recording head in the second specific example of the joint part. In the figure, numeral 52 is a projection. When the ink tank 1 is attached to the recording head 3, the joint part 2 of the ink tank 1 abuts the ink introduction part 4 of the recording head 3. Then, the connection part capillary member 18 is pressed slightly by the ink introduction part 4 and becomes deformed to the inside of the ink tank 1, as shown in FIG. 7B. Since the presser part 17 placed in the guide 41 retains the connection part capillary member 18 from the face opposite to the face of the connection part capillary member 18 abutting the ink introduction part 4, the presser part 17 also becomes elastically deformed. Thus, if the connection part capillary member 18 is pressed, it is retained by the elastic force of the presser part 17, trouble such that the connection part capillary member 18 is detached by press pressure as in the conventional structure does not occur. Since the connection part capillary member 18 is held by the guide 42 made of an elastic member, a good seal is provided even if the connection part capillary member 18 becomes deformed; ink does not leak from the periphery of the connection part capillary member 18.

When the guide 42 is made of an elastic member, a structure can also be adopted wherein projections 52 are made surrounding the ink introduction part 4 on the recording head 3 side and are abutted against the guide 42 when the ink tank is attached. According to this structure, the air tight property of the joining part can be furthermore enhanced and the entry stroke of the ink introduction part 4 on the recording head 3 side can also be defined. In this case, the recording head 3 may not be provided with the joining member 21.

Figure 8A:
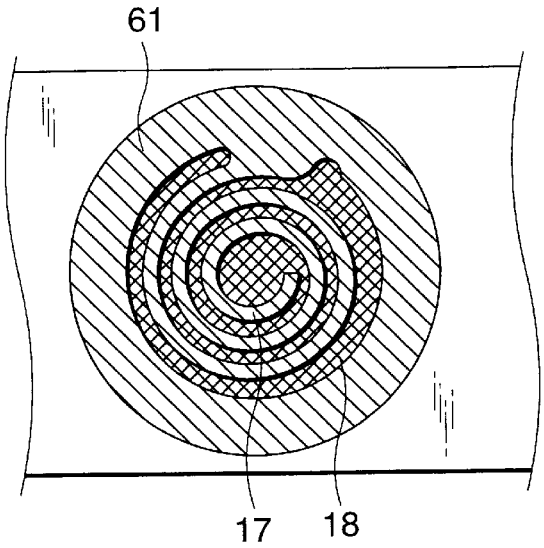
FIGS. 8A are 8B are enlarged views to show a third specific example of the joint part.
Figure 8B:
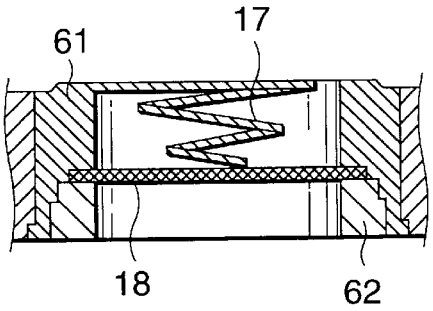

FIGS. 8A and 8B show a third specific example of the joint part; In FIGS. 8A and 8B, numerals 61 and 62 are guides. In the third specific example like the second specific example, a presser part 17 is formed in the same member as the guide 61. A connection part capillary member 18 is sandwiched between the guides 61 and 62, as in the first specific example. In the third specific example, the presser part 17 is made spiral, for example. Such a spiral structure can be easily formed when the guide 61 is formed.

Figure 9A:
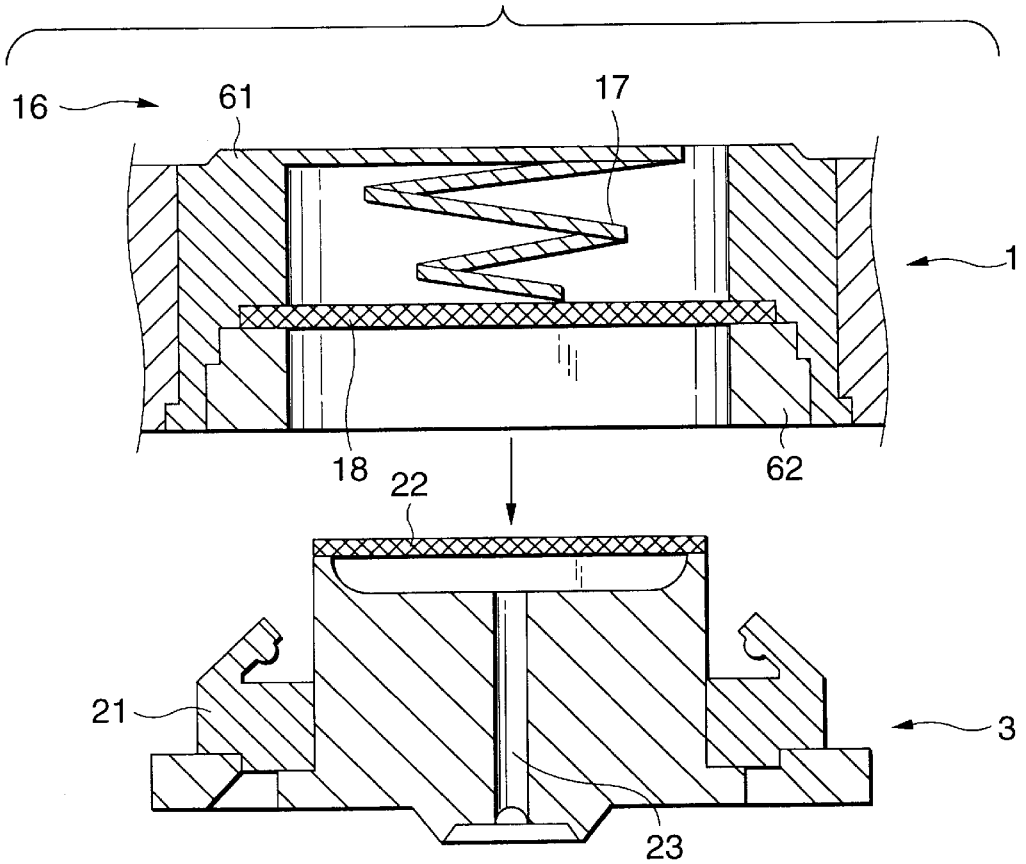
FIGS. 9A and 9B are a sectional view to show a state before and after connection to a recording head in the third specific example of the joint part.
Figure 9B:
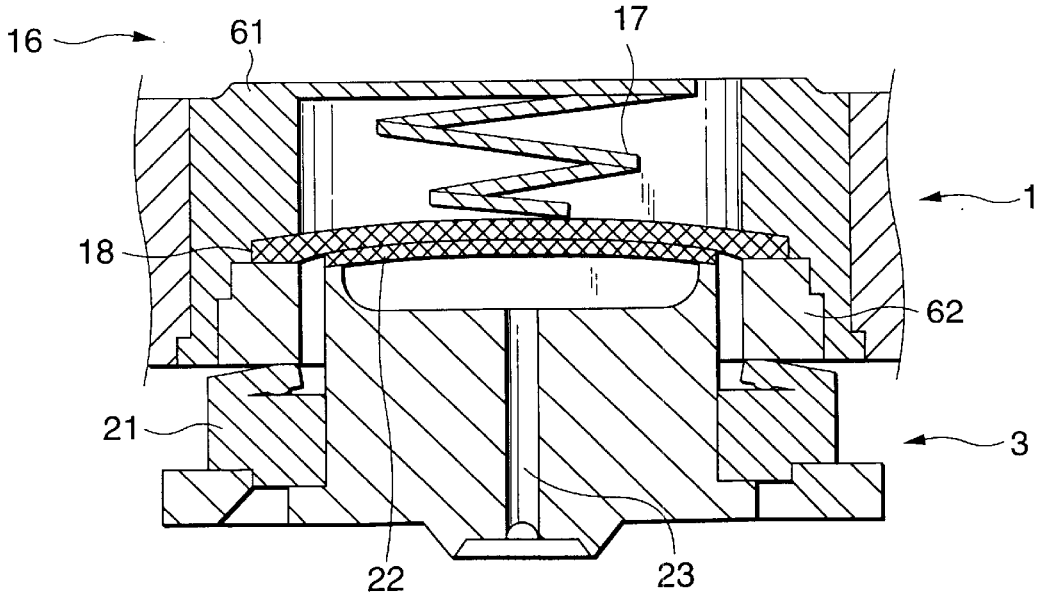

FIGS. 9A and 9B show a state before and after connection to the recording head in the third specific example of the joint part. When the ink tank 1 is attached to the recording head 3, the connection part capillary member 18 abuts the ink introduction part 4 of the recording head 3 and becomes slightly deformed. At this time, the connection part capillary member 18 is retained by the elastic force of the spiral presser part 17 from the inside of the ink tank 1, thus detachment of the connection part capillary member 18 by press pressure of the ink introduction part 4 does not occur.

Figure 10A:
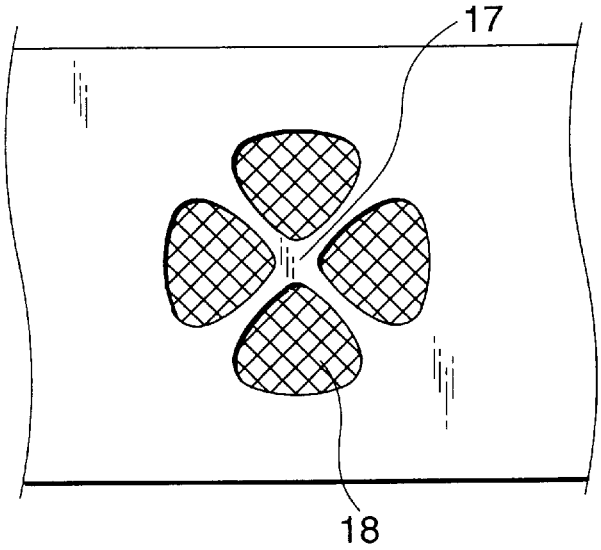
FIGS. 10A and 10B are enlarged views to show a fourth specific example of the joint part.
Figure 10B:
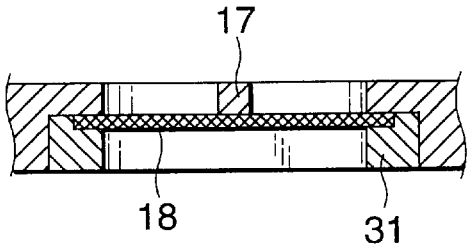

FIGS. 10A and 10B show a fourth specific example of the joint part. In the example, a presser part 17 is formed like rough meshes, not projections. One or more smaller holes than the connection part capillary member 18 may be thus made at positions corresponding to the connection part capillary member 18.

Figure 11A:
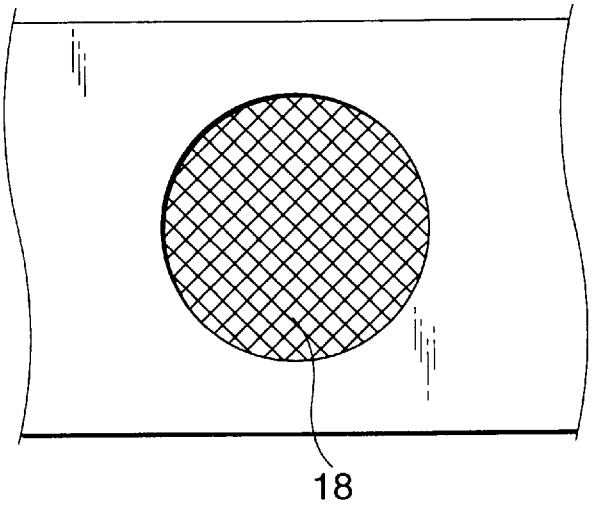
FIGS. 11A and 11B are enlarged views to show a fifth specific example of the joint part.
Figure 11B:
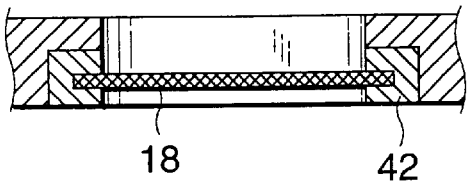

FIGS. 11A and 11B show a fifth specific example of the joint part. In the example, a guide 42 is made of an elastic member and guide 41 is not provided. In the fifth specific example, the guide 42 itself is used as a presser part 17. In this case, arm-like or spiral projections as in the above-described examples do not exist and the guide 42 retains the connection part capillary member 18 from the periphery thereof and press pressure of the connection part capillary member 18 is absorbed by the elastic force of the guide 42.

The specific examples can be used in combination appropriately. The structure of the ink tank is not limited to the examples; the invention can be applied regardless of the shape of the ink tank if the ink tank has the joint part 2 and an ink flow passage leading to the intermediate chamber for holding only ink or the joint part 2.

FIGS. 12 to 27B show an second embodiment of a printer and an ink tank of the invention.

To easily understand the description that follows, rectangular coordinate axes X, Y, and Z are defined in directions of arrows X, Y, and Z orthogonal to each other in the accompanying drawings; the arrow X direction is the front, the arrow Y direction is the left, and the arrow Z direction is the top (up, upward). In this case, the opposite direction (−X direction) to the X direction (front) becomes the rear, the opposite direction (−Y direction) to the Y direction (left) becomes the right, and the opposite direction (−Z direction) to the Z direction (top (up, upward)) becomes the bottom (down, downward).

The front (X direction) and rear (−X direction) are collectively called the front and rear or X axis direction, the left (Y direction) and right (−Y direction) are collectively called the left and right or Y axis direction, and the top (Z direction) and bottom (−Z direction) are collectively called the top and bottom or Z axis direction.

Further, in the accompanying drawings, a symbol of circled ● means an arrow directed from the rear of the paper face to the front and a symbol of circled X means an arrow directed from the front of the paper face to the rear.

Figure 12:
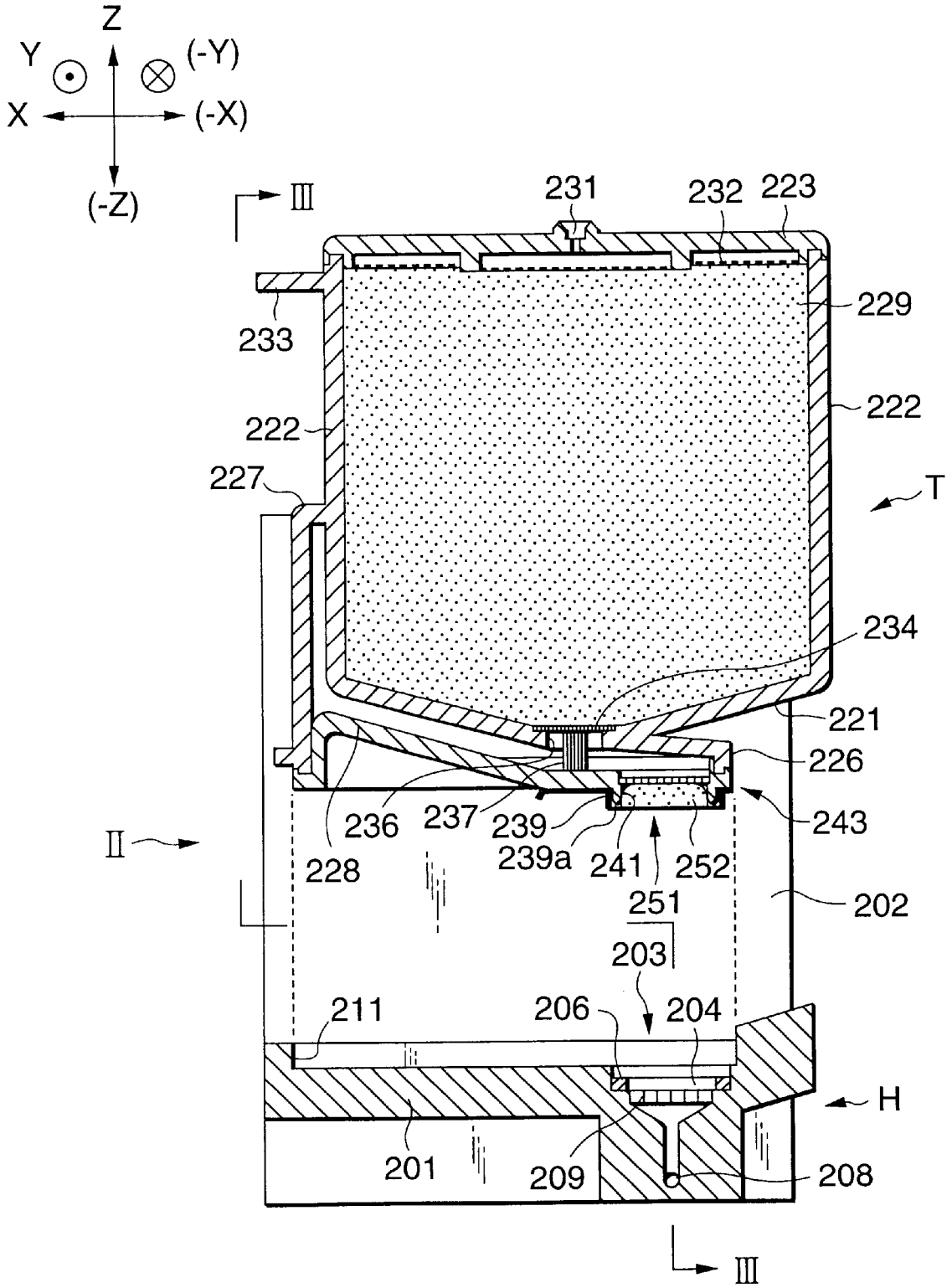
FIG. 12 is an illustration of an ink tank of an second embodiment of the invention and a recording head section H to which the ink tank is attached.
Figure 13:
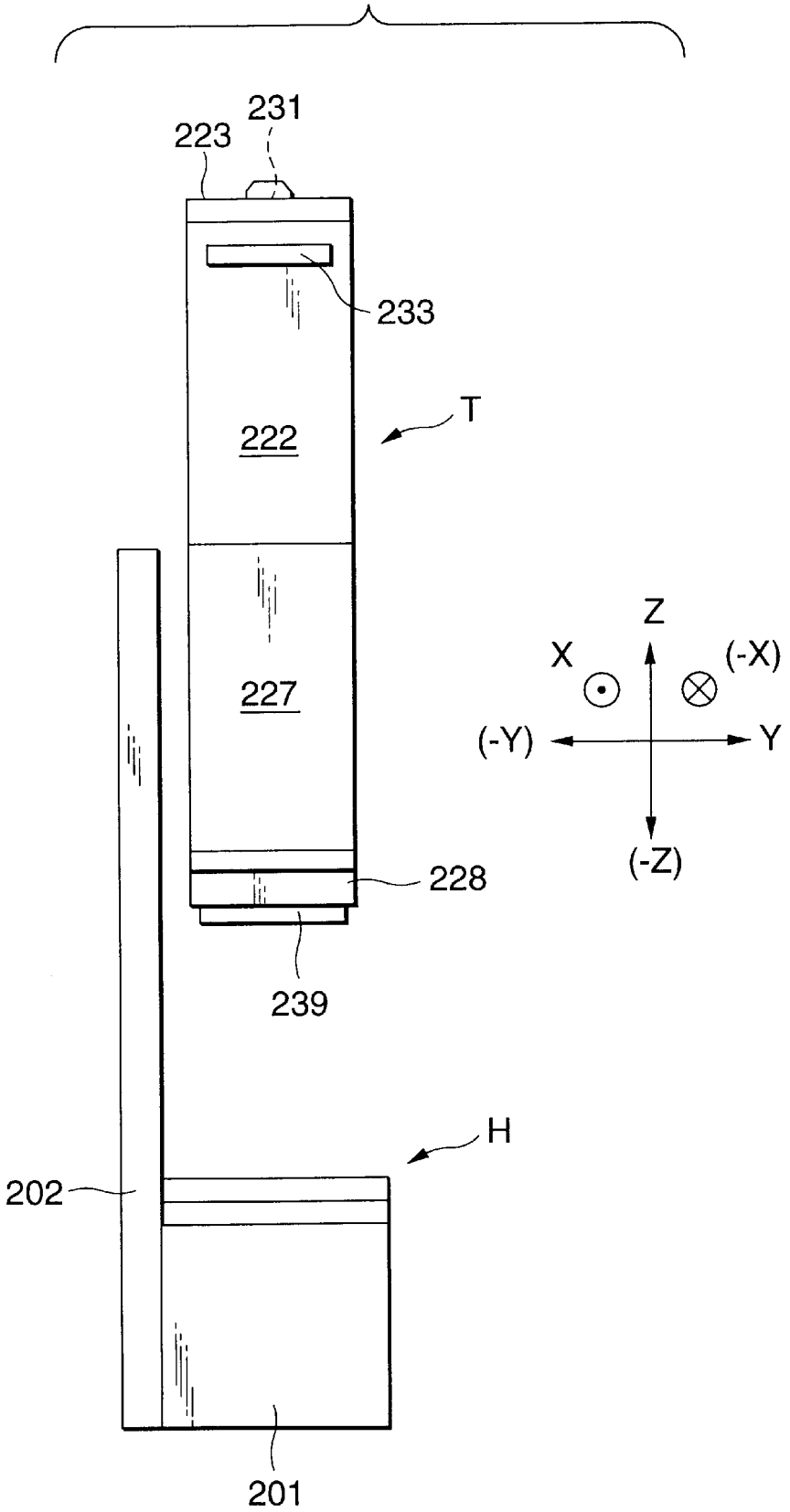
FIG. 13 is a view of FIG. 12 from arrow II.
Figure 14:
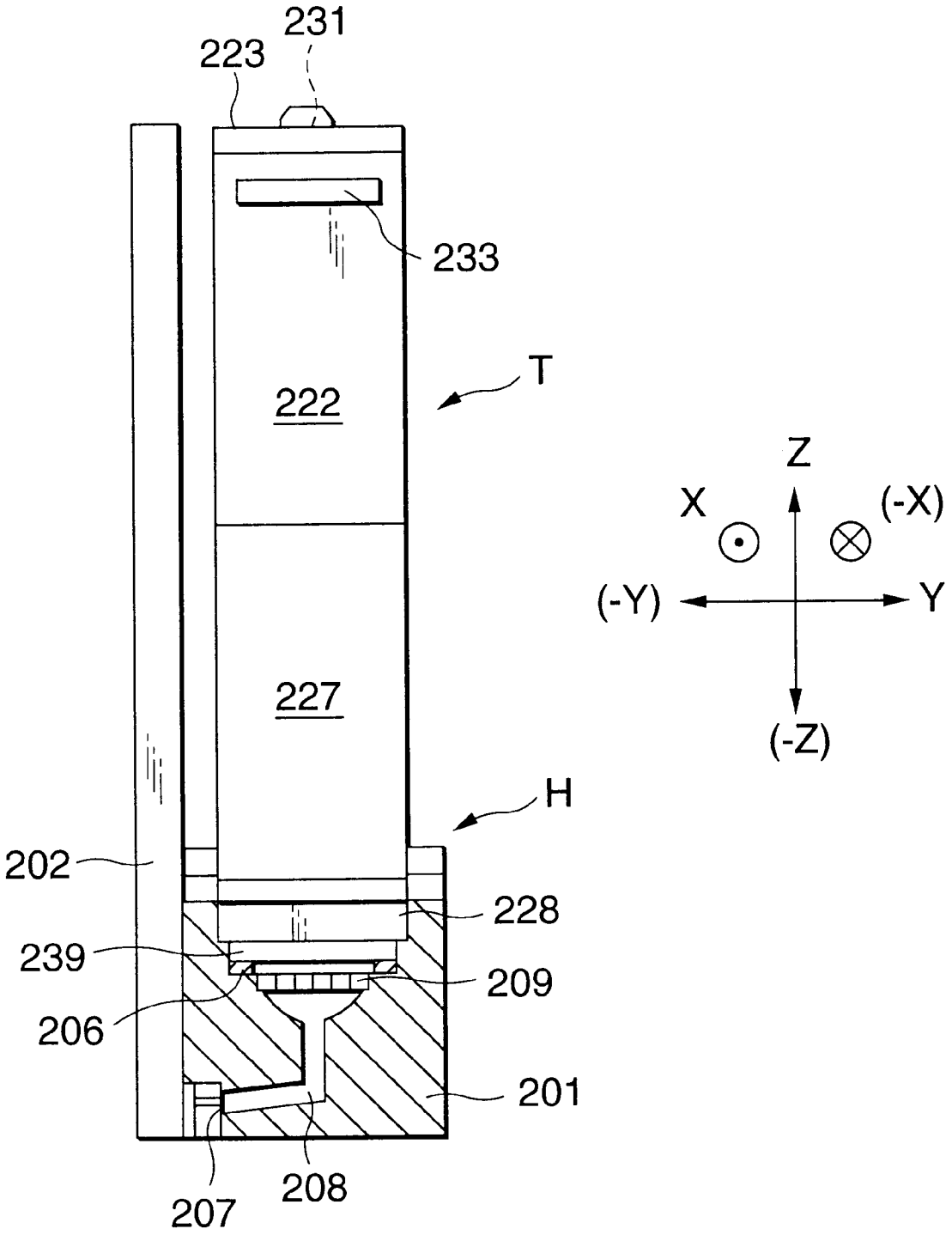
FIG. 14 is a sectional view taken on line III—III in FIG. 12.

In FIGS. 12 to 14, the recording head section H is made up of a recording head member 201 and a recording head circuit board 202. The recording head member 201 is provided with a recording head joint part 203 having an ink inflow hole 204 and a ring-like abutment member 206 disposed in the ink inflow hole 204. Preferably, a material having resistance to ink is adopted for the ring-like abutment member 206; in this embodiment, silicone rubber having a hardness of 30 degrees is adopted.

An ink flow passage 208 for supplying ink to a plurality of ink jet nozzles 207 arranged in the left and right direction (Y axis direction) (see FIG. 14) is disposed below the recording head joint part 203. A filter 209 is placed between the recording head joint part 203 and the ink flow passage 208. In this embodiment, a stainless mesh filter having a filtration particle size of 3–60 microns is adopted for the filter 209.

The recording head circuit board 202 is formed with a heating element (not shown) for heating ink supplied to a plurality of ink jet ports (not shown) of the jet nozzles 207 in response to an image signal, generating bubbles, and jetting ink drops, a circuit (not shown) for energizing the heating element, and the like. Such an art is already known.

A tank attachment hole 211 to which the ink tank T of the embodiment is attached detachably is made in the top face of the recording head member 201.

The recording head section H is fixed to a head carriage (not shown) of an ink jet recorder and is supported by a guide rod (not shown) disposed at the lower part of the head carriage for reciprocating motion in the left and right direction (Y axis direction). As with the conventional ink jet recorder, the head carriage is coupled to a drive belt (not shown) and normally stops at a home position. At the home position, the ink jet nozzles 207 of the recording head section H fixed to the head carriage are sealed by a nozzle sealing cap (not shown) by a capping unit (not shown). Previously known devices, parts, units, etc., can be adopted for the head carriage, the guide rod, the capping unit, etc.

Figure 15A:
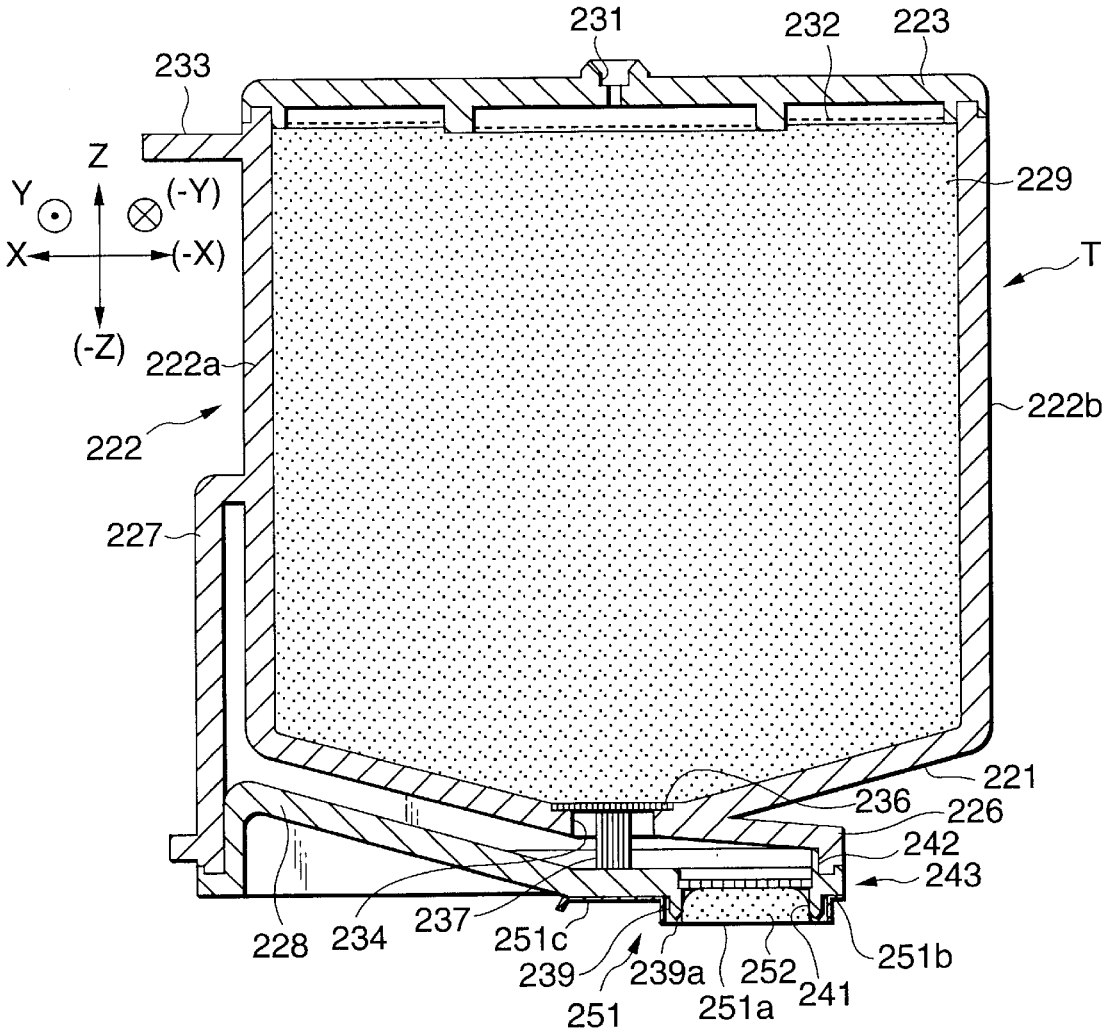
FIGS. 15A and 15B are an enlarged illustration of the ink tank of the second embodiment of the invention.
Figure 15B:
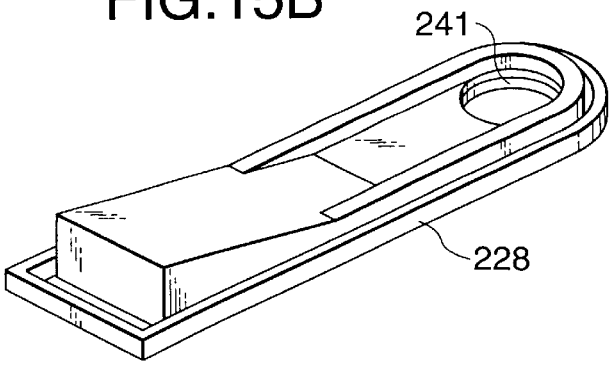

In FIGS. 12 and 15, the ink tank T has a bottom wall 221, side walls 222, and a top wall 223 closing the top ends of the side walls 222. The bottom wall 221 and the side wall 222 are provided with coupling wall members 226 and 227 respectively, and a joint bottom wall member 228 (see FIG. 15B) is disposed at the lower ends of the coupling wall members 226 and 227.

An ink holding body 229 made of felt or sponge for holding ink is housed in a space surrounded by the walls 221–223. A communication hole 231 with the atmosphere is made in the top wall 223. A film member 232 is placed on the surface of the ink holding body 229 connected to the communication hole 231. The film member 232 prevents ink held in the ink holding body 229 from flowing out from the communication hole 231. It is made of a material such as Gore-Tex (registered trademark) for allowing only air to pass through and blocking ink. The film member 232 can be omitted. A handle 233 is located on the front part of the side wall 222.

In FIG. 15A, a communication hole 234 is made in the bottom wall 221. A first meniscus formation member 236 for keeping a supplied ink pressure constant is put on the communication hole 234 and a core material 237 is placed under the first meniscus formation member 236.

The first meniscus formation member 236 uses a 40-micron product of filtration particle size of a stainless mesh filter. The first meniscus formation member 236 has a function of forming and holding an ink meniscus (ink film) for holding downstream pressure negative relative to the atmosphere and a function of preventing air from entering the downstream side.

The core material 237 is a member for sucking up ink from the downstream side and supplying the ink in order to wet the first meniscus formation member 236 when ink runs out on the upstream side of the first meniscus formation member 236. It is made of a polyethylene fiber bundle, a polyester fiber bundle, a polyethylene plus polyethylene fiber bundle, or the like.

Ink passing through the communication hole 234 is stored in the space surrounded by the bottom wall 221, the coupling wall members 226 and 227, the side walls 222, and the joint bottom wall member 228.

Figure 16:
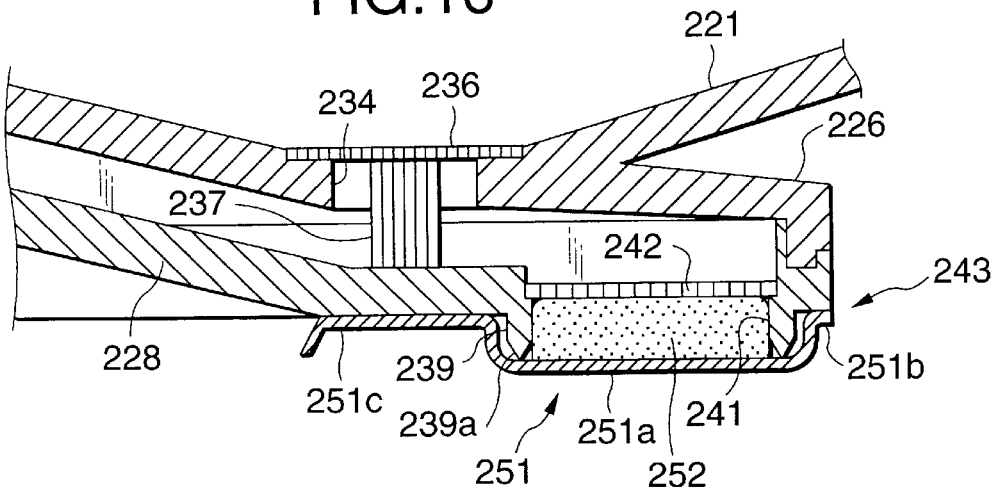
FIG. 16 is an enlarged illustration of the main part of the ink tank of the second embodiment of the invention.
Figure 17:
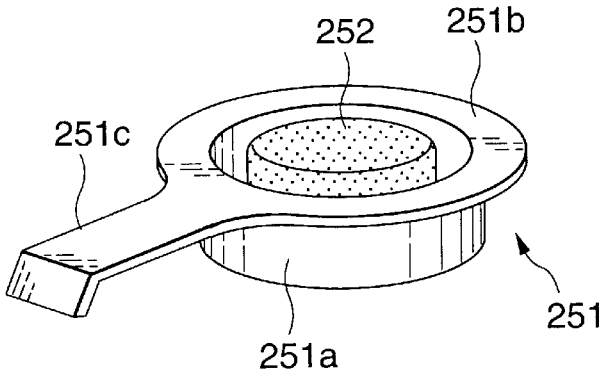
FIG. 17 is an illustration of a seal material of the second embodiment of the invention.
Figure 18:
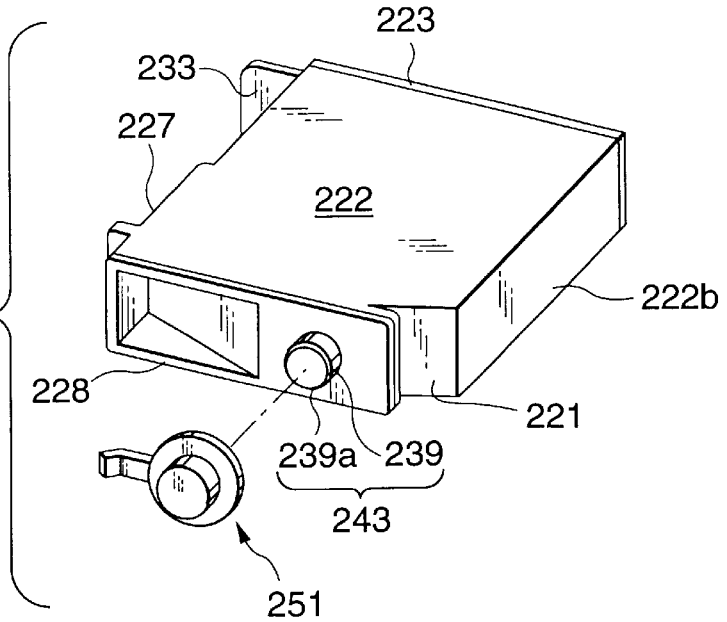
FIG. 18 is an illustration to show a state in which the seal material is peeled off from the ink tank of the second embodiment of the invention.

In FIGS. 15A and 16, the joint bottom wall member 228 has a cylindrical projection 239 projecting downward. A ring-like abutment part 239*a* is formed at the tip of the cylindrical projection 239. An ink supply hole 241 is made in the inside of the cylindrical projection 239. A second meniscus formation member 242 is placed on the ink supply hole 241. (See FIGS. 15 and 16.) The second meniscus formation member 242 has a function of leaking ink to the outside.

The cylindrical projection 239 having the ring-like abutment part 239*a* and the cylindrical projection 239 outer peripheral portion of the joint bottom wall member 228 make up a tank joint part 243 of the second embodiment of the invention. The elements denoted by the reference numerals 201–243 make up the ink tank T of the second embodiment of the invention.

As shown in FIG. 16, in the second embodiment of ink tank T of the invention, a seal material 251 is put on the ink tank T below the cylindrical projection 239. The seal material 251 has a closing part 251*a* abutting the ring-like abutment part 239*a* at the tip of the cylindrical projection 239 for closing the ink supply hole 241. The closing part 251*a* of the second embodiment is formed to swell so as to be able to cover the cylindrical projection 239. A bonding outer margin part 251*b* is formed on the outer periphery of the closing part 251*a*. The bonding outer margin part 251*b* of the seal material 251 is bonded to the lower face of the joint bottom wall member 228 with an adhesive. In the second embodiment, a substance with polyethylene on the bonding face to which aluminum laminate is applied is used as the seal material 251.

The bonding outer margin part 251*b* is formed with a pull 251*c* for the worker to easily peel off the seal material 251 at the replacement time of the ink tank T. A columnar ink absorption material 252 is fixedly secured to the inside of the closing part 251*a*. (See FIG. 17.) When the bonding outer margin part 251*b* of the seal material 251 is bonded to the lower face of the joint bottom wall member 228, the columnar ink absorption material 252 made of a urethane sponge having large elasticity is placed in the cylindrical projection 239 in a compression state. It can be made of felt or a non-elastic member of PVA form, melamine form, etc., in place of the urethane sponge and be placed in the cylindrical projection 239 in a non-compression state.

When replacing the ink tank T, the worker peels off the seal material 251 to attach a new ink tank T to the recording head section H. (See FIG. 18.) At this time, the worker can peel off the seal material 251 easily because the seal material 251 has the pull 251*c*. (See FIGS. 16 and 17.) When the seal material 251 is peeled off, the ink absorption material 252 swells due to its elastic force and raises the blow hole percentage at the same time as the seal material 251 is peeled off. Thus, the ink absorption capability of the ink absorption material 252 rises and ink can be prevented from scattering from the ink supply hole 241 when the seal material 251 is peeled off.

If the ink absorption material 252 is made of felt, for example, and is placed closely in the space in the closing part 251*a* in a non-compression state, ink can also be prevented from scattering from the ink supply hole 241 when the seal material 251 is peeled off.

Figure 19:
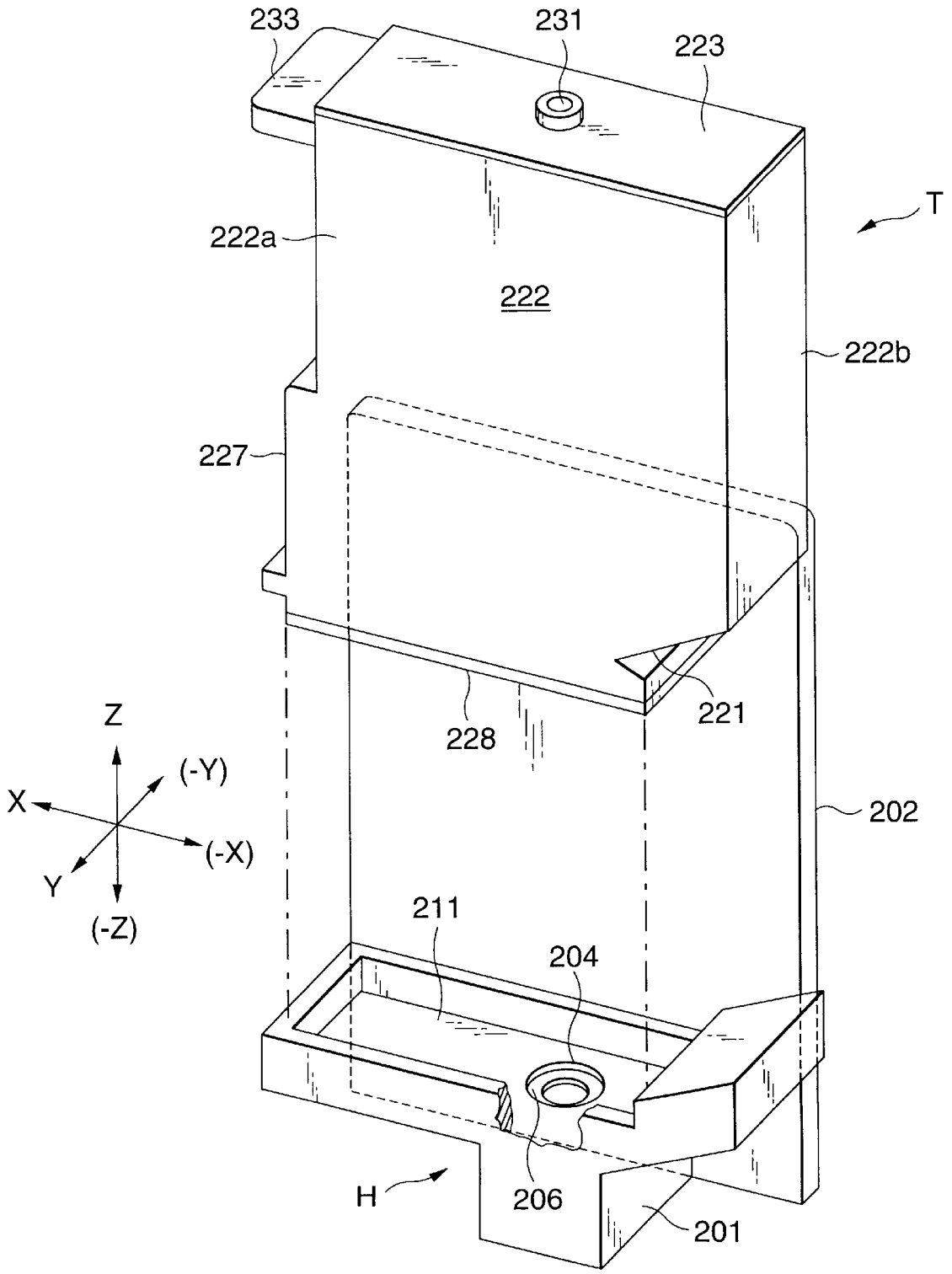
FIG. 19 is an illustration to show a state before the ink tank of the second embodiment of the invention is attached to the recording head section.
Figure 20:
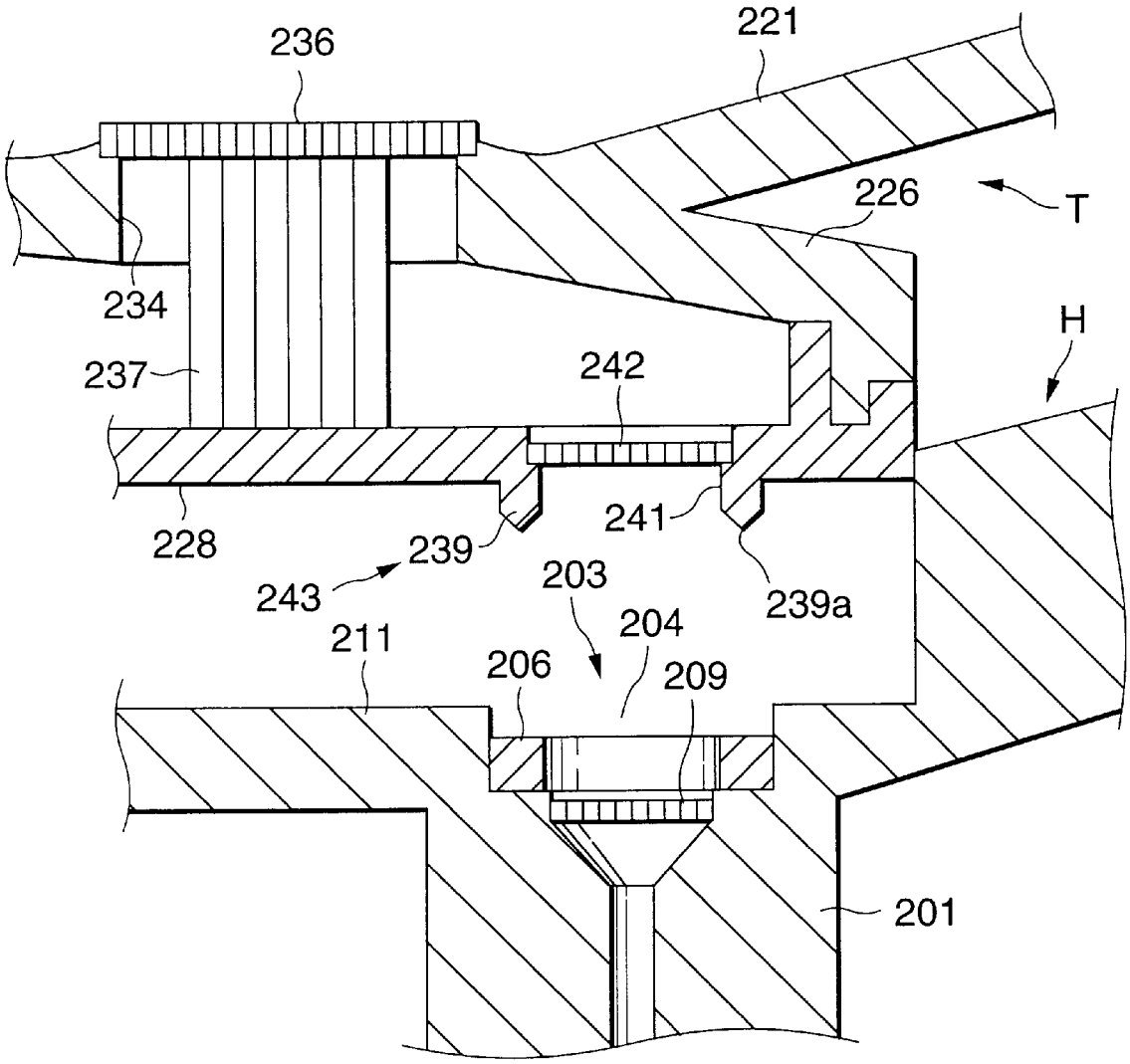
FIG. 20 is an illustration to show a state before the ink tank of the second embodiment of the invention is fitted into a tank holder hole.
Figure 21:
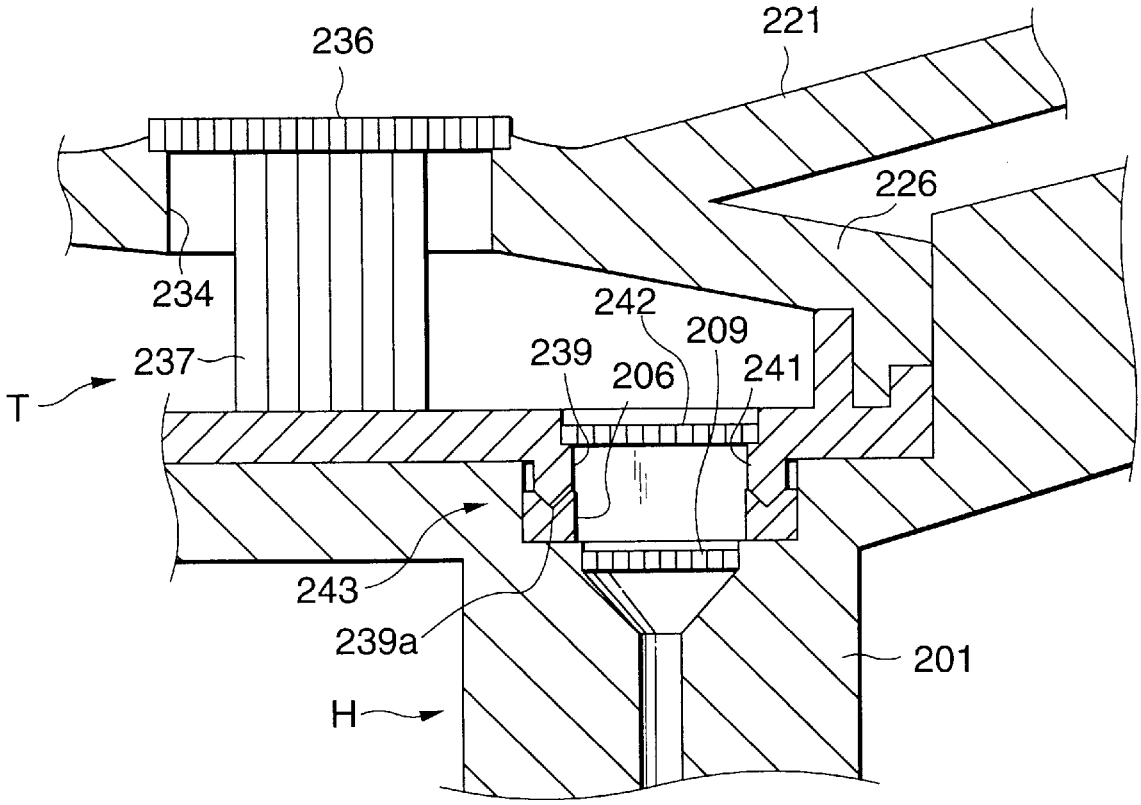
FIG. 21 is an illustration to show a state in which the ink tank of the second embodiment of the invention is attached to the recording head section.

Next, the worker brings the ink tank T close to the recording head section H from the state shown in FIG. 19. When the ink tank T approaches the recording head section H, the joint bottom wall member 228 of the ink tank T fits into the tank holder hole 211 of the recording head section H. (See FIG. 20.)

When the worker furthermore inserts the ink tank T into the recording head section H, the ring-like abutment part 239*a* at the tip of the cylindrical projection 239 of the ink tank T abuts the ring-like abutment part 206 and the ink tank T is attached to the recording head section H. At this time, the ring-like abutment part 206 becomes elastically deformed to the shape of the ring-like abutment part 239*a* by press pressure of the ink tank T. Thus, ink leakage from the joint part of the head joint part 203 and the tank joint part 243 does not occur. The adhesive left on the lower face of the joint bottom wall member 228 when the seal material 251 is peeled off is positioned outside the joint part of the head joint part 203 and the tank joint part 243, thus does not dissolve in supplied ink.

Since the bonding outer margin part 251*b* of the seal material 251 is bonded to the outside face of the joint bottom wall member 228 in the second embodiment, a bonding area sufficient to make the seal material 251 hard to peel off can be provided. Thus, the seal material 251 can be made hard to peel off and the ink tank T when it is not used can be stored easily. Since the adhesive remaining on the lower face of the joint bottom wall member 228 after the seal material 251 is peeled off does not dissolve in ink, it is not feared that ink will be degraded.

Next, a third embodiment of the ink tank of the invention will be discussed with reference to FIGS. 22 and 23. Components identical with or similar to those previously described in the second embodiment are denoted by the same reference numerals in the third embodiment and will not be discussed again.

Figure 22:
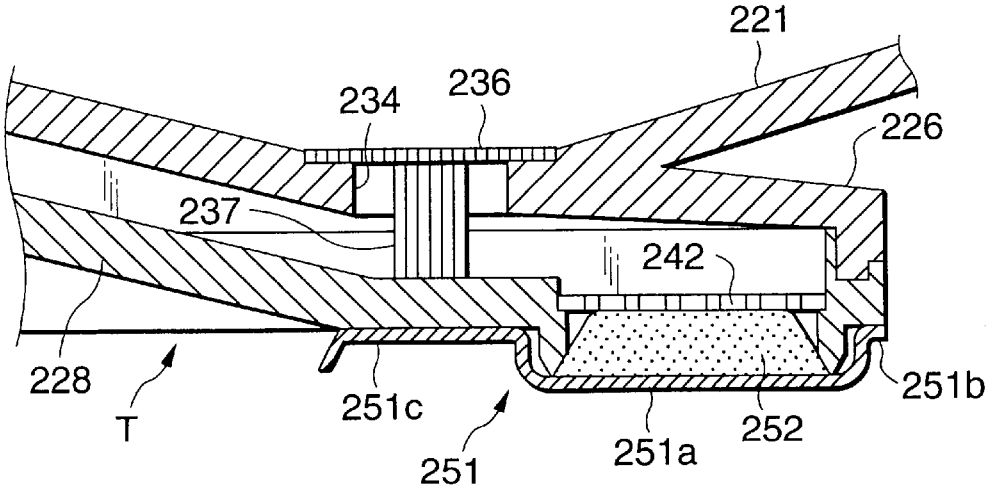
FIG. 22 is an enlarged illustration of the main part of an ink tank of a third embodiment of the invention, corresponding to FIG. 16 of the second embodiment.
Figure 23:
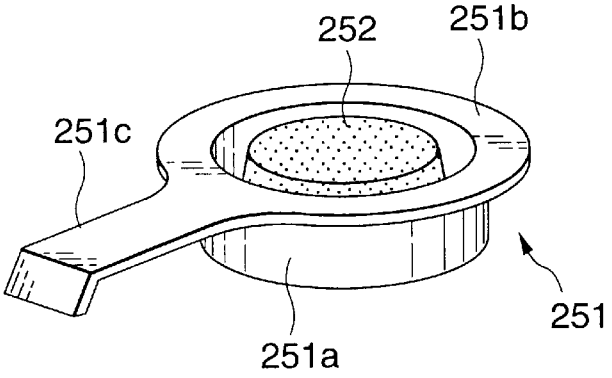
FIG. 23 is an illustration of a seal material of the third embodiment of the invention, corresponding to FIG. 17 of the second embodiment.

The third embodiment is the same as the second embodiment except in the following point:

In FIGS. 22 and 23, an ink absorption material 252 of the third embodiment is shaped like a truncated cone unlike the elastic ink absorption material 252 of the second embodiment formed like a column.

Also in the third embodiment, when the seal material 251 is peeled off, the ink absorption material 252 swells due to its elastic force and raises the blow hole percentage. Thus, the ink absorption capability of the ink absorption material 252 rises and ink can be prevented from scattering from an ink supply hole 241 when the seal material 251 is peeled off.

Since a bonding outer margin part 251*b* of the seal material 251 is bonded to the outside face of a joint bottom wall member 228, a bonding area sufficient to make the seal material 251 hard to peel off can be provided. Thus, the seal material 251 can be made hard to peel off and the ink tank T when it is not used can be stored easily. Since the adhesive remaining on the lower face of the joint bottom wall member 228 after the seal material 251 is peeled off does not dissolve in ink, it is not feared that ink will be degraded.

Next, a fourth embodiment of the ink tank of the invention will be discussed with reference to FIGS. 24 and 25.

Components identical with or similar to those previously described in the second embodiment are denoted by the same reference numerals in the fourth embodiment and will not be discussed again.

Figure 24:
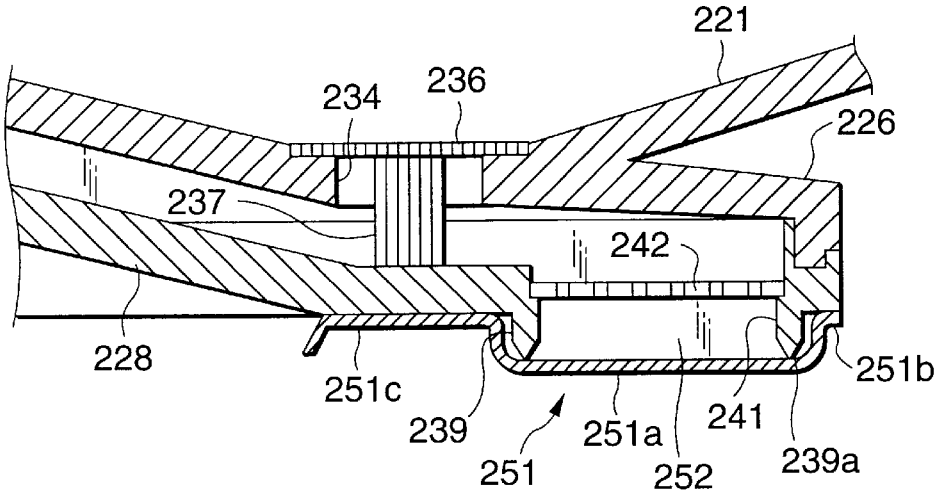
FIG. 24 is an enlarged illustration of the main part of an ink tank of a fourth embodiment of the invention, corresponding to FIG. 16 of the second embodiment.
Figure 25:
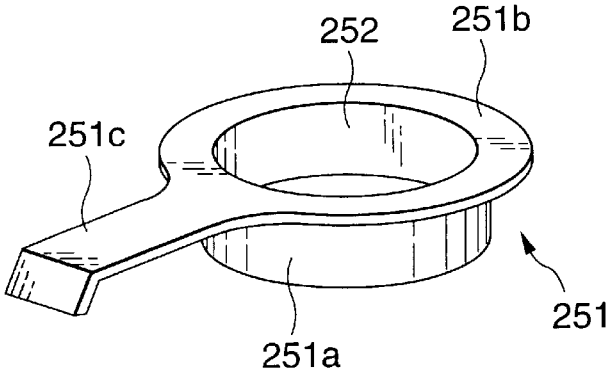
FIG. 25 is an illustration of a seal material of the fourth embodiment of the invention, corresponding to FIG. 17 of the second embodiment.

The fourth embodiment is the same as the second embodiment except in the following point:

In FIGS. 24 and 25, the ink absorption material 252 in the closing part 251*a* is removed from the seal material 251 of the second embodiment.

Also in the fourth embodiment, since a bonding outer margin part 251*b* of the seal material 251 is bonded to the outside face of a joint bottom wall member 228, a bonding area sufficient to make the seal material 251 hard to peel off can be provided. Thus, the seal material 251 can be made hard to peel off and the ink tank T when it is not used can be stored easily. Since the adhesive remaining on the lower face of the joint bottom wall member 228 after the seal material 251 is peeled off does not dissolve in ink, it is not feared that ink will be degraded.

Next, a fifth embodiment of the ink tank of the invention will be discussed with reference to FIGS. 26 and 27.

Components identical with or similar to those previously described in the second embodiment are denoted by the same reference numerals in the fifth embodiment of the seal material and will not be discussed again.

Figure 26A:
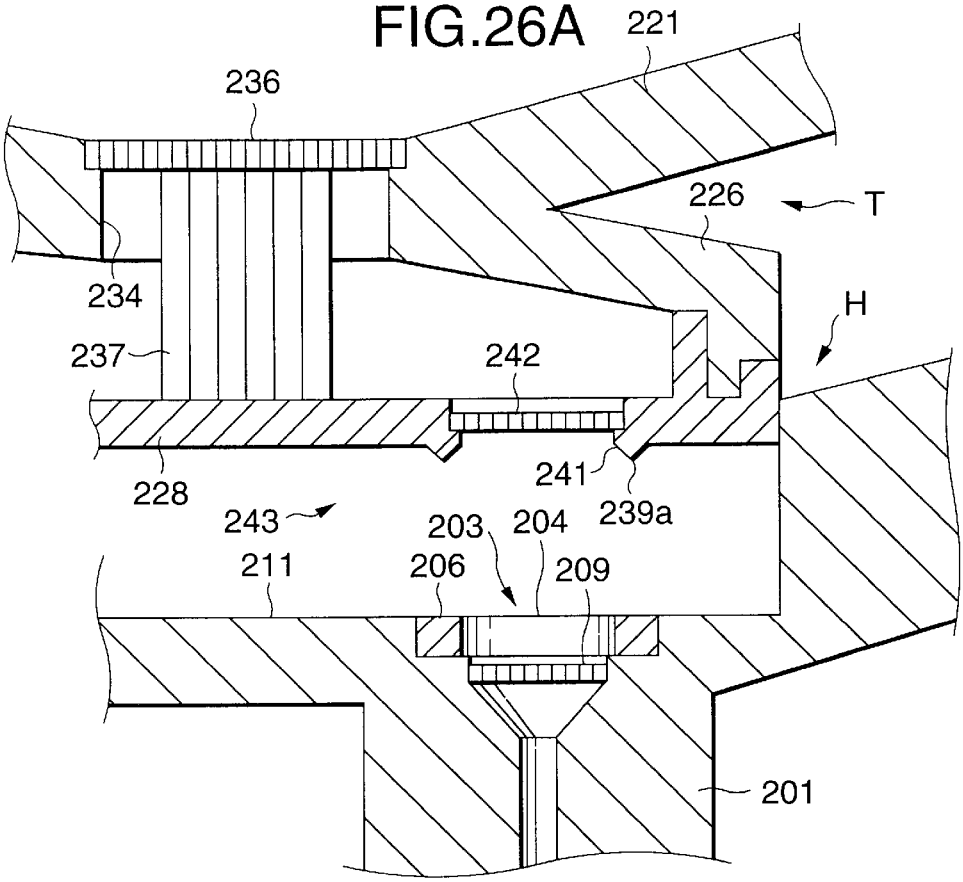
FIGS. 26A and 26B are an illustration of a state when an ink tank of a fifth embodiment of the invention is attached to a recording head section.
Figure 26B:
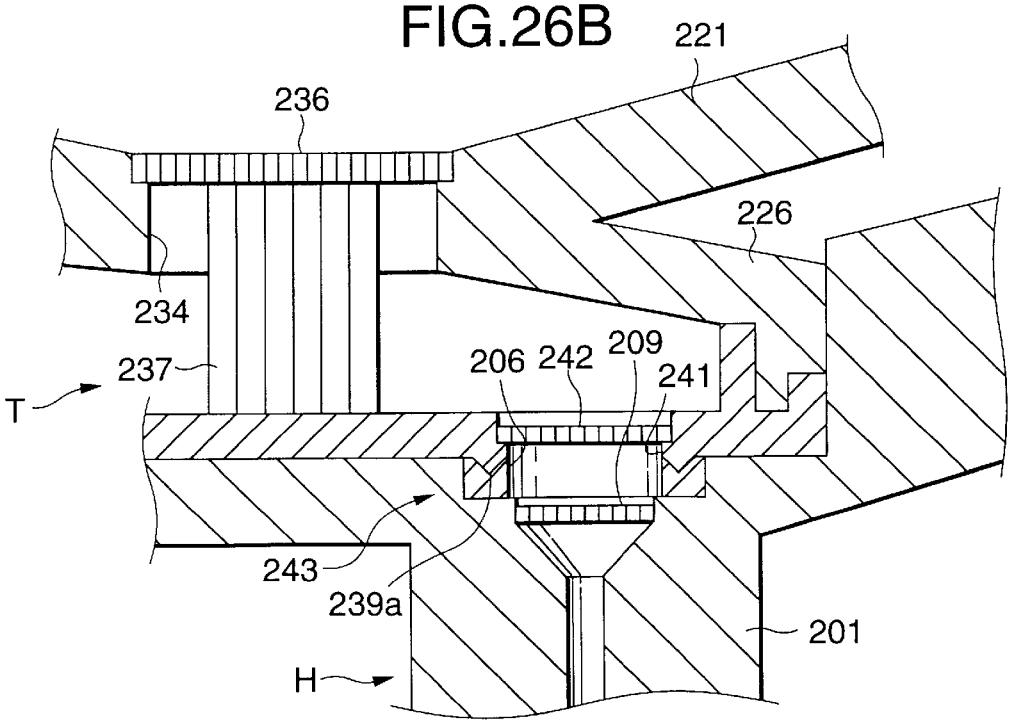
Figure 27A:
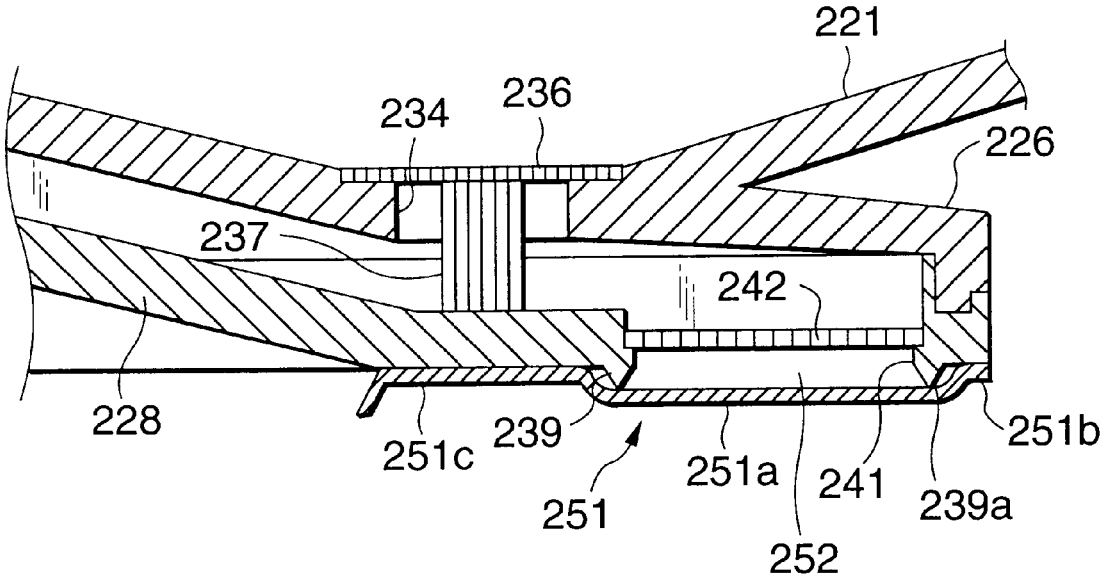
FIGS. 27A and 27B are an illustration of the main part of the ink tank of the fifth embodiment of the invention.
Figure 27B:
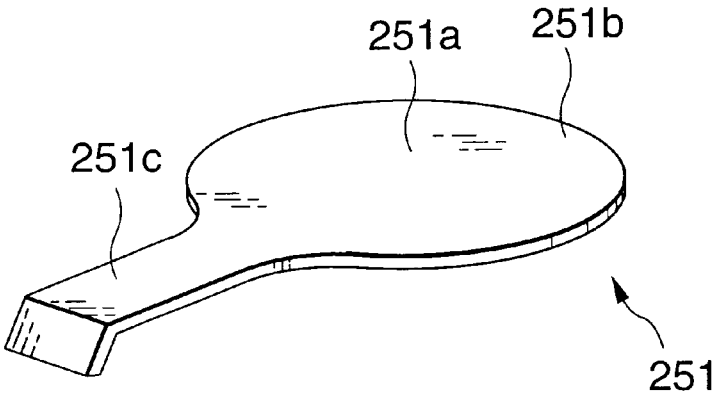
Figure 28A:
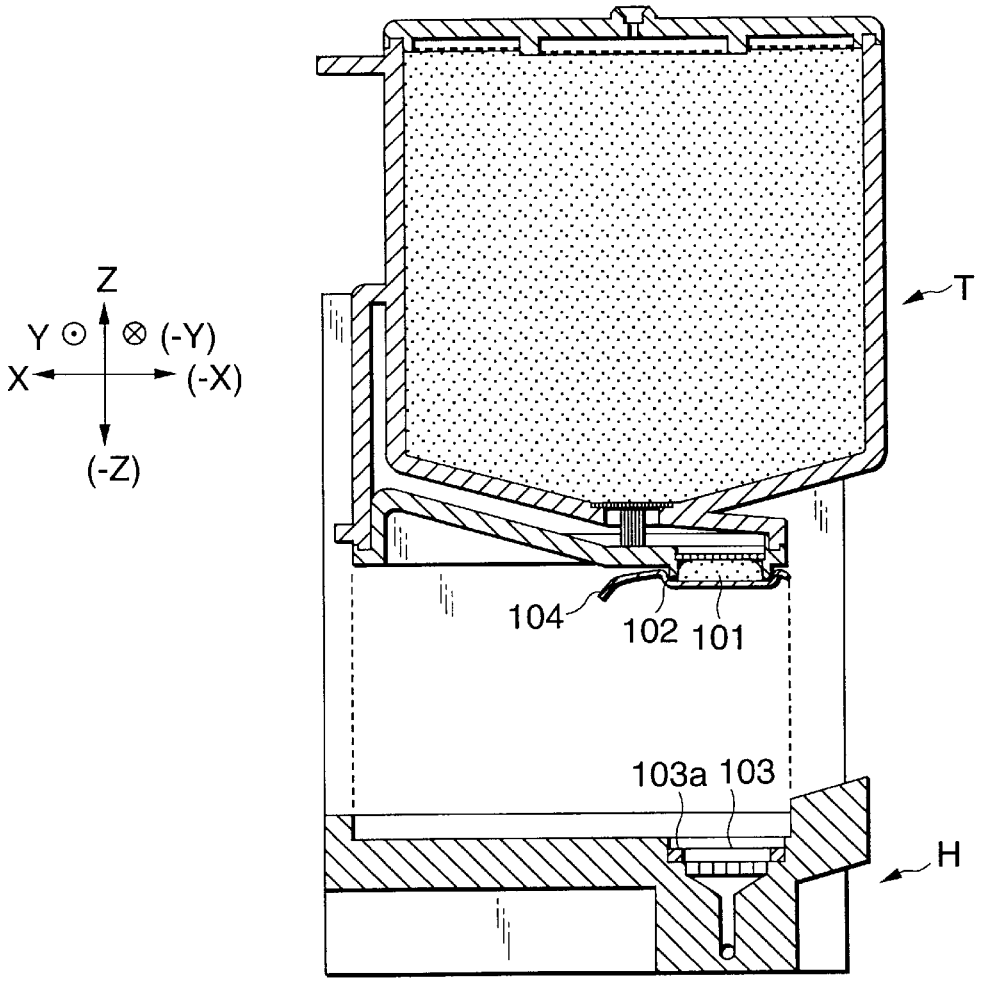
FIG.28A PRIOR ART
FIGS. 28A and 28B are a schematic illustration of an ink tank and a recording head section in related art.
Figure 28B:
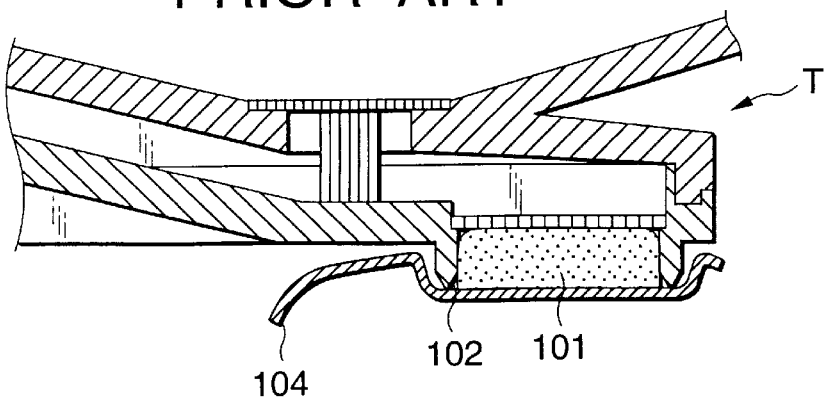
FIG.28B PRIOR ART

The fifth embodiment is the same as the second embodiment except in the following point:

In FIGS. 26 and 27, the cylindrical projection 239 of the second embodiment has only the ring-like abutment part 239*a* at the tip left and other parts removed. Therefore, the ring-like abutment part 239*a* projects a little from the lower face of joint bottom wall member 228 of the ink tank T. Therefore, even if closing part 251*a* of the seal material 251 bonded to the lower face of the joint bottom wall member 228 is not formed to swell, it can become deformed to a swell shape because of elastic deformation at the attachment time.

Therefore, the closing part 251*a* of the seal material 251 formed to swell in the second embodiment is not swelled and is made flat in the fifth embodiment, and the ink absorption material 252 of the second embodiment is removed. That is, in the fifth embodiment, the projection part of the cylindrical projection 239 is only the ring-like abutment part 239*a* and the projection amount is small, thus a swell as in the flexible sheet-like seal material 251 of the second embodiment need not be formed and the seal material 251 of the fifth embodiment is made flat. The seal material 251 of the fifth embodiment can be manufactured easily at low costs.

(Modification)

Although the invention has been described in detail, it is understood that the invention is not limited to the embodiments and the combination and arrangement of parts may be resorted to without departing from the spirit and the scope of the invention as hereinafter claimed. A modification of the invention is as follows:

The recording head section H in the embodiments can also be designed to be able to be attached to or detached from the head carriage (not shown) rather than fixed to the head carriage.

As seen from the description made so far, according to the invention, in the structure enabling the ink tank to be detached, when the ink tank is attached, bubbles are not mixed into the ink flow passage and ink does not leak either and danger, etc., to the user at the replacement time is avoided. Further, since the capillary member disposed in the joint part is retained by the presser part, trouble such that the capillary member is detached by press pressure when the ink tank is attached can be prevented.

Further, the ink tank of the invention can produce the following effects:

The seal material for sealing the ink supply hole is made hard to peel off, whereby ink leakage when the ink tank is stored can be prevented.

Since the seal material is bonded in the bonding outer margin part, the adhesive left after the seal material is peeled off does not come in contact with ink, so that degradation of ink can be prevented.

The ink absorption material is placed in the inside of the swell of the seal material, whereby ink can be prevented from scattering when the seal material is peeled off.

Since the tip of the ring-like abutment part is not deformed or made dirty, when the ink tank is attached to the recording head and the ring-like abutment part is abutted against the ring-like abutment member, ink leakage at the abutment part can be prevented.

What is claimed is:

1. An ink tank and recording head assembly, comprising:

a recording head section for jetting ink; and an ink tank for holding the ink to be supplied to said recording head section, said ink tank having a joint part for connecting said ink tank to said head section;

a capillary member attached to said joint part, said capillary member having an ink tank side that faces the ink tank and a recording head section side that faces the recording head section; and a presser part provided in said joint part on said ink tank side of and in contact with said capillary member to absorb press pressure exerted on said capillary member when said ink tank and said recording head section are connected.

2. The assembly according to claim 1, wherein said presser part is molded as a single piece with said ink tank.

3. The assembly according to claim 1, wherein said presser part is formed as a separate member from said ink tank.

4. The assembly according to claim 1, further comprising an elastic member surrounding said capillary member.

5. The assembly according to claim 4, wherein said recording head section has a projection which abuts against said elastic member.

6. The assembly according to claim 1, further comprising resin parts between which said capillary member is sandwiched.

7. The assembly according claim 6, wherein said resin parts are each molded as a single piece with with said presser part.

8. The assembly according to claim 1, wherein said capillary member is made of at least one of felt, nonwoven cloth and a porous substance.

9. The assembly of claim 1, wherein said capillary member and said presser part deform toward said ink tank if said ink tank and said recording head section are connected.

10. An ink tank connectible to a recording head section for supplying ink to the recording head section, comprising:

a main ink chamber which stores the ink;

a joint part for connecting said main ink chamber to said recording head section;

a capillary member attached to said joint part, said capillary member having a main ink chamber side that faces the main ink chamber and a recording head section side that faces the recording head section; and a presser part positioned on said main ink chamber side of and in contact with said capillary member to absorb press pressure exerted on said capillary member when said ink tank is connected to the recording head section.

11. The ink tank according to claim 10, wherein said presser part is molded as a single piece with said ink tank as a part thereof.

12. The ink tank according to claims 10, wherein said presser part is formed as a separate member from said ink tank.

13. The ink tank according to claim 10, further comprising an elastic member surrounding said capillary member.

14. The ink tank according to claim 13, wherein said recording head section has a projection which abuts against said elastic member.

15. The ink tank according to claim 10, further comprising resin parts between which said capillary member is sandwiched.

16. The ink tank according to claim 15, wherein said resin parts are each molded as a single piece with said presser part.

17. The ink tank according to claim 10, wherein a material of said capillary member is made of at least one of felt, nonwoven cloth and a porous substance.

18. An ink tank for an ink jet recorder, comprising:

an ink tank main unit having a tank joint part connected detachably to a recording head joint part having an ink inflow hole communicating with an ink nozzle for jetting ink to a print medium and a ring-line abutted member provided in the ink inflow hole, said tank joint part having a ring-like abutting part having a projecting tip abutting said ring-like abutted member if said tank joint part is connected to the recording head joint part, and an ink supply hole communicating with the ink inflow hole; and a seal material formed of a flexible sheet for covering said ring-like abutting part to seal said ink supply hole if said tank joint part is detached from the recording head joint part, said seal material having a bonding outer margin part bonded to an outside surface of said ink tank main unit outside said ring-like abutting part and a closing part disposed in an inner portion of said bonding outer margin part for closing said ink supply hole.

19. The ink tank according to claim 18, wherein said closing part abuts a tip of said ring-like abutting part.

20. The ink tank according to claim 19, wherein said closing part is formed to swell so as to cover said ring-like abutment part having the tip.

21. The ink tank according to claim 20, wherein said seal material has an ink absorption material placed in said closing part.

22. The ink tank of claim 20, wherein said capillary member and said presser part deform toward said ink chamber if said main ink chamber and the recording head section are connected.

* * * * *